US011686196B2

(12) United States Patent
Ramasamy et al.

(10) Patent No.: US 11,686,196 B2
(45) Date of Patent: Jun. 27, 2023

(54) DOWNHOLE ACTUATION SYSTEM AND METHODS WITH DISSOLVABLE BALL BEARING

(71) Applicant: SAUDI ARABIAN OIL COMPANY, Dhahran (SA)

(72) Inventors: Jothibasu Ramasamy, Dhahran (SA); Chinthaka Pasan Gooneratne, Dhahran (SA); Jianhui Xu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/541,796

(22) Filed: Dec. 3, 2021

(65) Prior Publication Data

US 2022/0090494 A1 Mar. 24, 2022

Related U.S. Application Data

(63) Continuation-in-part of application No. 16/720,879, filed on Dec. 19, 2019, now Pat. No. 11,230,918.

(51) Int. Cl.

| | |
|---|---|
| ***E21B 47/12*** | (2012.01) |
| ***E21B 17/20*** | (2006.01) |
| ***E21B 44/00*** | (2006.01) |

(52) U.S. Cl.

CPC ..... *E21B 47/138* (2020.05); *E21B 17/20* (2013.01); *E21B 44/005* (2013.01)

(58) Field of Classification Search

CPC ..... E21B 17/20; E21B 47/01; E21B 47/138; E21B 44/005; E21B 23/00

See application file for complete search history.

(56) References Cited

U.S. PATENT DOCUMENTS

| | | | |
|---|---|---|---|
| 4,760,882 | A | 8/1988 | Novak |
| 4,771,982 | A | 9/1988 | Bodine et al. |

(Continued)

FOREIGN PATENT DOCUMENTS

| | | | |
|---|---|---|---|
| CA | 2894558 | A1 | 8/2014 |
| CA | 2929482 | A1 | 6/2015 |

(Continued)

OTHER PUBLICATIONS

International Search Report and Written Opinion for Intemaltion Application No. PCT/US2020/066221 (SA51188) report dated Mar. 29, 2021; pp. 1-12.

(Continued)

*Primary Examiner* — Caroline N Butcher
(74) *Attorney, Agent, or Firm* — Bracewell LLP; Constance G. Rhebergen; Eleanor L. Tyson

(57) ABSTRACT

Systems and methods for instructing a device within a wellbore of a subterranean well includes a drill string with an actuator assembly extending into the subterranean. The actuator assembly has a first pipe member with a segment formed of a first material. A second pipe member is coaxially aligned with the first pipe member. A plurality of bearings are positioned between the first pipe member and the second pipe member. Each of the plurality of bearings includes a second material. The first material is reactive to the second material. Certain of the plurality of bearings are changeable bearings that include a dissolvable material. The actuator assembly is operable to instruct an operation of the device by generating an instruction signal by rotating the first pipe member relative to the second pipe member and interpreting a pattern of a reaction of the segment as a bearing rotates past the segment.

24 Claims, 13 Drawing Sheets

(56) References Cited

U.S. PATENT DOCUMENTS

| | | | |
|---|---|---|---|
| 5,186,257 | A | 2/1993 | Stahl et al. |
| 5,697,442 | A | 12/1997 | Baldridge |
| 6,302,201 | B1 | 10/2001 | Elliott |
| 7,191,830 | B2 | 3/2007 | Mcvay et al. |
| 7,273,102 | B2 | 9/2007 | Sheffield |
| 7,303,016 | B2 | 12/2007 | Kristiansen |
| 7,493,956 | B2 | 2/2009 | Shaw et al. |
| 7,503,398 | B2 | 3/2009 | Logiudice et al. |
| 7,510,001 | B2 | 3/2009 | Spring et al. |
| 7,931,091 | B2 | 4/2011 | Bailey et al. |
| 8,016,036 | B2 | 9/2011 | Kirkwood et al. |
| 8,122,950 | B2 | 2/2012 | Daniel et al. |
| 8,215,393 | B2 | 7/2012 | Mackay et al. |
| 8,284,075 | B2 | 10/2012 | Fincher et al. |
| 8,394,464 | B2 | 3/2013 | Bailey et al. |
| 8,639,186 | B2 | 1/2014 | Ayers |
| 8,800,880 | B2 | 8/2014 | Christiansen |
| 9,115,573 | B2 | 8/2015 | Purkis et al. |
| 9,382,769 | B2 | 7/2016 | Wilson et al. |
| 9,488,046 | B2 | 11/2016 | Purkis |
| 9,506,326 | B2 | 11/2016 | Hay et al. |
| 9,567,819 | B2 | 2/2017 | Cavender et al. |
| 9,574,439 | B2 | 2/2017 | Joseph et al. |
| 9,677,371 | B2 | 6/2017 | Richards et al. |
| 9,822,611 | B2 | 11/2017 | Delzell et al. |
| 9,890,319 | B2 | 2/2018 | Ezell et al. |
| 9,970,246 | B2 | 5/2018 | Price Hoelscher et al. |
| 10,000,681 | B2 | 6/2018 | Livanec et al. |
| 10,047,604 | B2 | 8/2018 | Graves et al. |
| 10,053,978 | B2 | 8/2018 | Hay et al. |
| 10,669,789 | B2 | 6/2020 | Budler et al. |
| 10,837,260 | B2 | 11/2020 | Mcclean et al. |
| 10,844,689 | B1 | 11/2020 | Ramasamy et al. |
| 2009/0090514 | A1 | 4/2009 | Bailey et al. |
| 2010/0051275 | A1 | 3/2010 | Lewis et al. |
| 2010/0263867 | A1 | 10/2010 | Horton et al. |
| 2011/0048697 | A1 | 3/2011 | Lewis et al. |
| 2011/0284245 | A1 | 11/2011 | Crandall et al. |
| 2013/0118733 | A1 | 5/2013 | Kumar |
| 2013/0126164 | A1 | 5/2013 | Sweatman et al. |
| 2013/0284518 | A1 | 10/2013 | Wu et al. |
| 2013/0292175 | A1 | 11/2013 | Radford et al. |
| 2014/0318806 | A1 | 10/2014 | Machocki |
| 2015/0114646 | A1 | 4/2015 | Price Hoelscher et al. |
| 2016/0053572 | A1 | 2/2016 | Snoswell |
| 2016/0164437 | A1 | 6/2016 | Kim et al. |
| 2016/0244654 | A1 | 8/2016 | Way et al. |
| 2017/0015887 | A1 | 1/2017 | De Stefano et al. |
| 2017/0159363 | A1 | 6/2017 | Lazarev et al. |
| 2017/0183938 | A1 | 6/2017 | Inglis |
| 2017/0247607 | A1 | 8/2017 | Hundt |
| 2017/0292371 | A1 | 10/2017 | Hay |
| 2017/0293044 | A1 | 10/2017 | Gilstrap et al. |
| 2017/0322341 | A1 | 11/2017 | Galliano et al. |
| 2017/0342826 | A1 | 11/2017 | Wilson et al. |
| 2018/0030824 | A1 | 2/2018 | Roberson et al. |
| 2018/0051700 | A1 | 2/2018 | Sheth et al. |
| 2018/0082090 | A1 | 3/2018 | Roberson |
| 2018/0262127 | A1 | 9/2018 | Gooneratne et al. |
| 2019/0031951 | A1 | 1/2019 | Johnson et al. |
| 2019/0093459 | A1 | 3/2019 | Mau et al. |
| 2019/0323311 | A1 | 10/2019 | Al-Qasim et al. |
| 2020/0208510 | A1 | 7/2020 | Guijt et al. |

FOREIGN PATENT DOCUMENTS

| | | | |
|---|---|---|---|
| DE | 60305190 | T2 | 11/2006 |
| EP | 2501032 | A2 | 9/2012 |
| EP | 2497899 | B1 | 4/2016 |
| WO | 2011041562 | A2 | 4/2011 |
| WO | 2012122178 | A2 | 9/2012 |
| WO | 2012154473 | A1 | 11/2012 |
| WO | 2015016858 | A1 | 2/2015 |
| WO | 2015040241 | | 3/2015 |
| WO | 2016043979 | A1 | 3/2016 |
| WO | 2018013312 | A1 | 1/2018 |
| WO | 2019005556 | A1 | 1/2019 |
| WO | 2019209824 | A1 | 10/2019 |

OTHER PUBLICATIONS

International Search Report and Written Opinion for International Application No. PCT/US2020/065736 (SA51165), report dated Mar. 25, 2021; pp. 1-13.

International Search Report and Written Opinion for International Application No. PCT/US2020/065808 (SA51186) report dated Apr. 15, 2021; pp. 1-12.

International Search Report and Written Opinion for International Application No. PCT/US2020/066136 (SA51187) report dated Apr. 13, 2021; pp. 1-11.

International Search Report and Written Opinion for International Application No. PCT/US2022/051025, dated Apr. 13, 2023; pp. 1-13.

International Search Report and Written Opinion for International Application No. PCT/US2022/051026 dated Mar. 2, 2023; pp. 1-15.

DOWNHOLE ACTUATION SYSTEM AND METHODS WITH DISSOLVABLE BALL BEARING

CROSS REFERENCE TO RELATED APPLICATION

This application is a continuation in part of, and claims priority to and the benefit of, co-pending U.S. application Ser. No. 16/720,879, filed Dec. 19, 2019, titled "Systems And Methods For Controlled Release Of Sensor Swarms Downhole," the full disclosure of which is hereby incorporated herein by reference in its entirety for all purposes.

BACKGROUND

1. Field of the Disclosure

The present disclosure relates in general to subterranean well developments, and more particularly to actuation and sensing systems for gathering downhole information.

2. Description of the Related Art

When drilling a subterranean well, operators are unable to view the trajectory of the wellbore and the downhole environment directly. In addition, once tools, instruments, equipment, and other devices are lowered in the wellbore they are inaccessible from the surface. Conventional techniques to control downhole tools or instruments or devices from the surface include mechanical methods, such as applying weight-on-bit and rotating the drill string assembly, applying pressure and dropping balls, or hydraulic methods such as fluid pressure cycles and flowing pressure cycles.

Radio frequency identification ("RFID") based systems have also been developed for drilling applications. RFID tags are programmed with a unique code at the surface are dropped into wells and travel downhole with the drilling fluid flow. Downhole devices such as bypass valves, reamers or packers are integrated with an RFID reader. The RFID reader consists of a battery, electronics and an antenna encapsulated for protection. The RFID tags are energized by the antenna of the reader when they are in the vicinity of each other. The antenna constantly generates a radio frequency field to 'listen' to RFID tags. The readers have the ability to only respond to a specific identification code and to ignore other codes, and also to eliminate repetition of operations by only accepting a unique code once. The biggest advantage RFID-based systems have is that they place no restrictions on the inner diameter of the drill string compared to the procedure normally used for activating bypass valves, which involves dropping an activation ball. RFID systems enable remote activation and places no restrictions inside the drill string, resulting in a larger flow area for the drilling fluids, allows any logging instrument to pass through the drill string without restriction.

SUMMARY OF THE DISCLOSURE

Mechanical and hydraulic methods of instructing downhole devices can introduce certain restrictions and potential challenges or issues to the drilling process. For example, actuation systems that include dropping an activation ball to open side ports requires applying pressure from the surface, which can damage downhole components. Such a system also requires extra trips downhole to remove the balls or to ream to ball from the drill string assembly.

RFID systems have drawbacks. For example, RFID systems require a drilling fluid flow for the RFID tag to travel through the drill string assembly and towards the RFID reader to activate or deactivate downhole devices. In addition, the RFID tag must be in the correct or optimized orientation when passing through the RFID reader antenna to transmit its unique identification number and specific instructions to the RFID reader. Further, once the RFID tags are dropped from the surface there is no control of the tag from the surface and multiple RFID tags need to be deployed down the drill string for multiple activation/deactivation operations. The RFID reader antenna takes up space in the drill pipe and can also be contaminated by debris from drilling fluids. In addition, the RFID reader antenna is always on because it has to 'listen' for an RFID tag signal. An operation cannot be ceased or started immediately if required as another RFID tag will have to be deployed to activate, deactivate, or reset a downhole device and the timing of the activation or deactivation will depend on the time taken for the RFID tag to reach the vicinity of the RFID reader.

Systems and methods of this disclosure overcome the deficiencies of both of the currently available mechanical and RFID system. Systems and methods of this disclosure can communicate with and deliver instruction signals to downhole devices in real-time. Embodiments of this disclosure provide a downhole actuation system that can be controlled from the surface to actuate digitally enabled downhole devices, such as tools and instruments. Actuation of these different devices can enable the execution of discrete drilling workflows. The actuation system is a separate system that can be seamlessly integrated with the downhole devices so that it does not displace existing drilling portfolios.

In embodiments of this disclosure, a set of signal pattern is created and interpreted by digital logics which are then converted to send specific signals to activate or deactivate a particular device. The initial set of ball bearings of the system are used to generate a first set of signals for interpretation as a first set of instructions to the downhole device. Dissolvable materials that are used to form certain of the bearings can then be dissolved to generate a different set of signals that will be interpreted as different instructions to the device, or can be used to instruct a different device, for performing other functions downhole.

In an embodiment of this disclosure, a system for instructing a device within a wellbore of a subterranean well includes a drill string extending into the subterranean well from a terranean surface. The drill string has an actuator assembly. The actuator assembly has a first pipe member with a segment formed of a first material. A second pipe member is coaxially aligned with the first pipe member. A plurality of bearings are positioned between the first pipe member and the second pipe member. Each of the plurality of bearings includes a second material. The first material is reactive to the second material. At least one of the plurality of bearings is a changeable bearing that includes a dissolvable material. The actuator assembly is operable to instruct an operation of the device by generating an instruction signal by rotating the first pipe member relative to the second pipe member and interpreting a pattern of a reaction of the segment as the plurality of bearings rotate past the segment.

In alternate embodiments, the changeable bearing can have an outermost layer of the dissolvable material, and the dissolvable material can be the second material. The changeable bearing can include a core bearing formed of an electrically insulating material, which is coated by the outermost layer of the dissolvable material. Alternately, the entire changeable bearing can be formed of the dissolvable material. Alternately, the changeable bearing can include a core bearing formed of the second material that is coated by an outermost layer of a dissolvable polymer that is the dissolvable material and that is non-reactive to the first material.

In other alternate embodiments, the plurality of bearings can include a side bearing, and the segment can be located on an outer diameter surface of the first pipe member and be axially aligned with the side bearing. The side bearing can be located between the outer diameter surface of the first pipe member and an inner diameter surface of the second pipe member. Alternately, the plurality of bearings can include a side bearing, and the segment can be located on an inner diameter surface of the first pipe member and be axially aligned with the side bearing. The side bearing can be located between the inner diameter surface of the first pipe member and an outer diameter surface of the second pipe member.

In still other alternate embodiments, the system can further include a support member extending radially inward from an inner diameter surface of the second pipe member. The support member can support the first pipe member within a central bore of the second pipe member. The plurality of bearings can include an end bearing, and the segment can be positioned at and end surface of the first pipe member and be radially aligned with the end bearing. The end bearing can be located between the end surface of the first pipe member and the support member secured to the second pipe member that extends radially from the second pipe member.

In yet other alternate embodiments, the actuator assembly can further include a digital logic circuit configured to receive and to interpret the pattern of the reaction of the segment as the plurality of bearings rotate past the segment, and to generate the instruction signal. The second pipe member can be operable to rotate with the drill string and the first pipe member can be located within the second pipe member and be circumscribed by the second pipe member. Alternately, the second pipe member can be operable to rotate with the drill string and the first pipe member can circumscribe the second pipe member.

In an alternate embodiment of this disclosure, a method for instructing a device within a wellbore of a subterranean well includes extending a drill string into the subterranean well from a terranean surface. The drill string includes an actuator assembly having a first pipe member with a segment formed of a first material. A second pipe member is coaxially aligned with the first pipe member. A plurality of bearings are positioned between the first pipe member and the second pipe member. Each of the plurality of bearings includes a second material, where the first material is reactive to the second material. At least one of the plurality of bearings is a changeable bearing that includes a dissolvable material. The method further includes instructing an operation of the device with the actuator assembly by generating an instruction signal by rotating the second pipe member relative to the first pipe member and interpreting a pattern of a reaction of the segment as the plurality of bearings rotate past the segment.

In alternate embodiments, the method can further include dissolving the dissolvable material and instructing a subsequent operation of the device with the actuator assembly by generating a revised instruction signal by rotating the second pipe member relative to the first pipe member and interpreting a revised pattern of the reaction of the segment as the plurality of bearings rotate past the segment. The changeable bearing can have an outermost layer of the dissolvable material and a core bearing formed of an electrically insulating material. The dissolvable material can be the second material, and dissolving the dissolvable material can include dissolving the outermost layer of the dissolvable material so that the changeable bearing is non-reactive to the first material. Alternately, the entire changeable bearing can be formed of the dissolvable material, where the dissolvable material is the second material, and dissolving the dissolvable material can include dissolving the entire changeable bearing. Alternately, the changeable bearing can include a core bearing formed of the second material that is coated by an outermost layer of a dissolvable polymer that is the dissolvable material and that is non-reactive to the first material, and dissolving the dissolvable material can include dissolving the outermost layer of the dissolvable material so that the changeable bearing is reactive to the first material.

In other alternate embodiments, the plurality of bearings can include a side bearing, and the segment can be located on an outer diameter surface of the first pipe member and be axially aligned with the side bearing. The side bearing can be located between the outer diameter surface of the first pipe member and an inner diameter surface of the second pipe member, and interpreting the pattern of the reaction of the segment as the plurality of bearings rotate past the segment can include interpreting the reaction of the segment as the side bearing rotates past the segment. Alternately, the plurality of bearings can include a side bearing, and the segment can be located on an inner diameter surface of the first pipe member and be axially aligned with the side bearing. The side bearing can be located between the inner diameter surface of the first pipe member and an outer diameter surface of the second pipe member, and interpreting the pattern of the reaction of the segment as the plurality of bearings rotate past the segment can include interpreting the reaction of the segment as the side bearing rotates past the segment.

In yet other alternate embodiments, the method can further include supporting the first pipe member within a central bore of the second pipe member with a support member extending radially inward from an inner diameter surface of the second pipe member. The plurality of bearings can include an end bearing, and the segment can be positioned at and end surface of the first pipe member and be radially aligned with the end bearing. The end bearing can be located between the end surface of the first pipe member and the support member secured to the second pipe member that extends radially from the second pipe member. Interpreting the pattern of the reaction of the segment as the plurality of bearings rotate past the segment can include interpreting the reaction of the segment as the end bearing rotates past the segment.

In still other alternate embodiments, the actuator assembly can further include a digital logic circuit, and the method can further include receiving and interpreting the pattern of the reaction of the segment as the plurality of bearings rotate past the segment, and generating the instruction signal with the digital logic circuit. The second pipe member can rotate with the drill string and the first pipe member can be located within the second pipe member and be circumscribed by the second pipe member, where rotating the second pipe member relative to the first pipe member can include rotating the drill string. Alternately, the second pipe member can rotate with the drill string and the first pipe member can circumscribe the second pipe member, where rotating the second pipe member relative to the first pipe member can include rotating the drill string.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
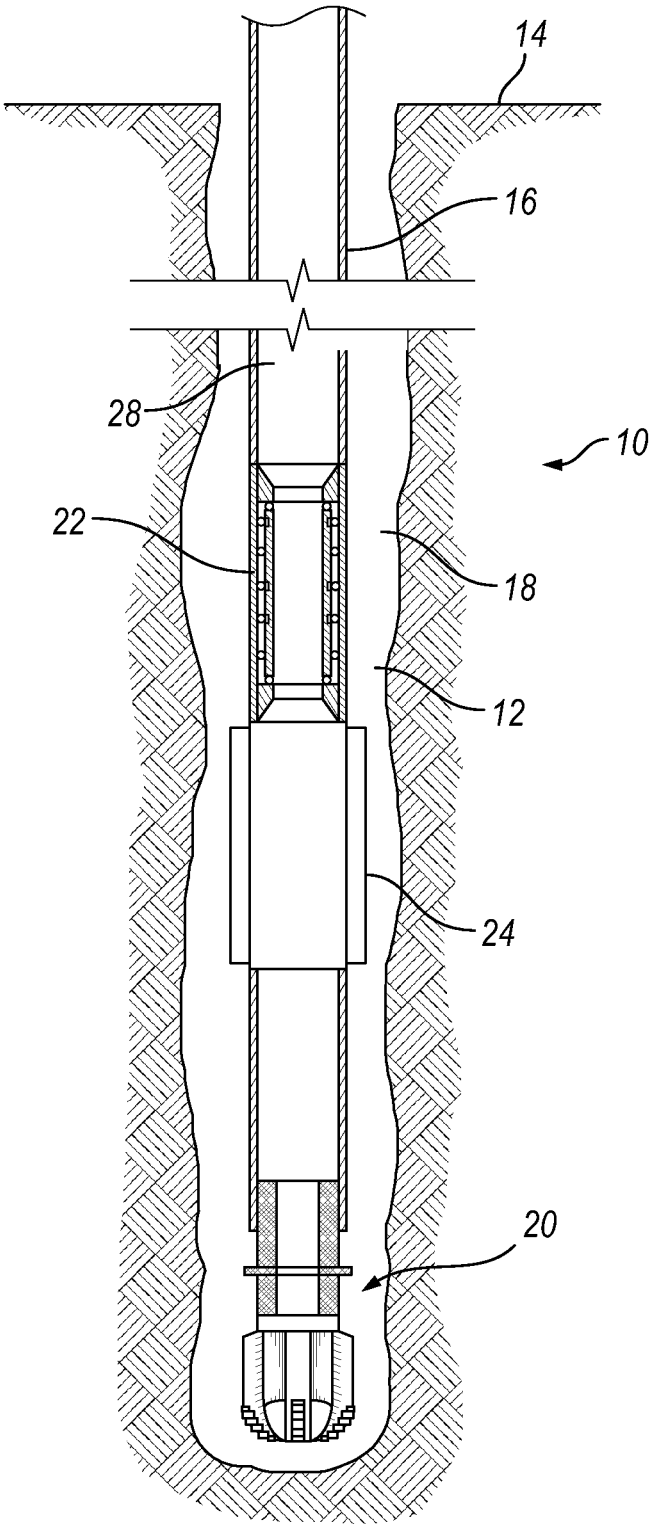
FIG. 1 is a section view of a subterranean well with a drill string having an actuator assembly and a sensor compartment, in accordance with an embodiment of this disclosure.

Looking at FIG. 1, subterranean well 10 can have wellbore 12 that extends to an earth's or terranean surface 14. Subterranean well 10 can be an offshore well or a land based well and can be used for producing hydrocarbons from subterranean hydrocarbon reservoirs, or can be otherwise associated with hydrocarbon development activities.

Drill string 16 can extend into and be located within wellbore 12. Annulus 8 is defined between an outer diameter surface of drill string 16 and the inner diameter of wellbore 12. Drill string 16 can include a string of tubular joints and bottom hole assembly 20. The tubular joints can extend from terranean surface 14 into subterranean well 10. Bottom hole assembly 20 can include, for example, drill collars, stabilizers, reamers, shocks, a bit sub and the drill bit. Drill string 16 can be used to drill wellbore 12. Drill string 16 has a string bore 28 that is a central bore extending the length of drill string 16. Drill string 16 can be rotated to rotate the bit to drill wellbore 12.

Drill string 16 can further include actuator assembly 22 and device 24. Actuator assembly and device 24 can be installed as drilling subs that are part of the drill string assembly. In the example embodiment of FIG. 1, actuator assembly 22 is shown extending radially into string bore 28 of drill string 16. In alternate embodiments, actuator assembly 22 can be located on an outer diameter surface of drill string 16. In the example embodiment of FIG. 1, device 24 is secured in line with joints of drill string 16. In alternate embodiments, device 24 can extend radially into string bore 28 of drill string 16, or can extend radially outward from drill string 16.

Figure 3:
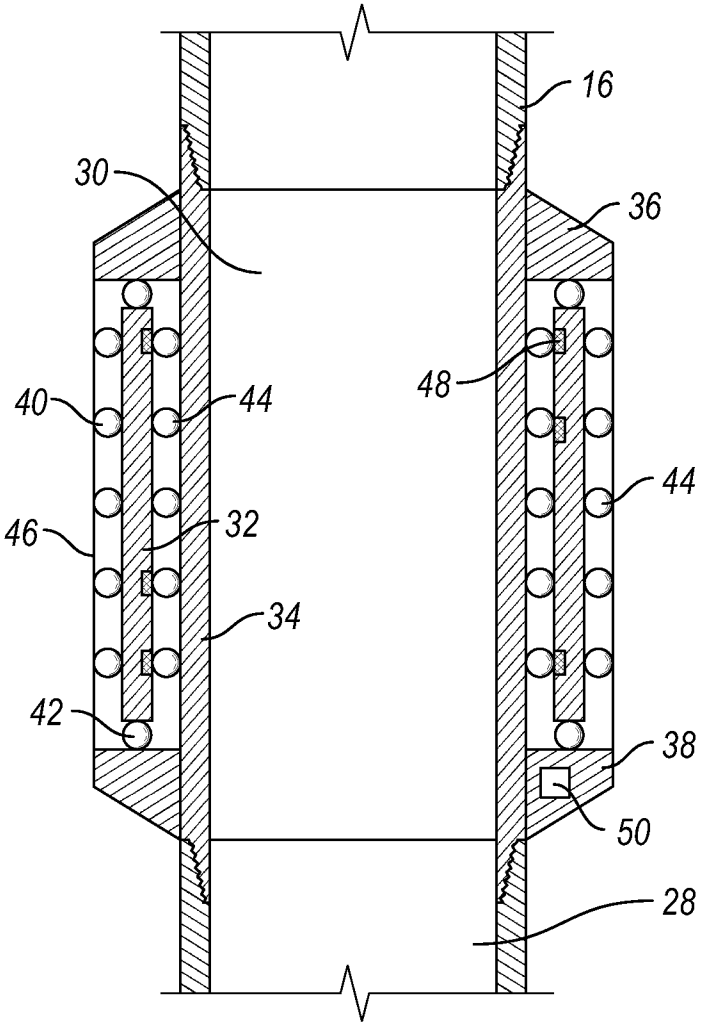
FIG. 3 is a section view of an actuator assembly, in accordance with an alternate embodiment of this disclosure.
Figure 2:
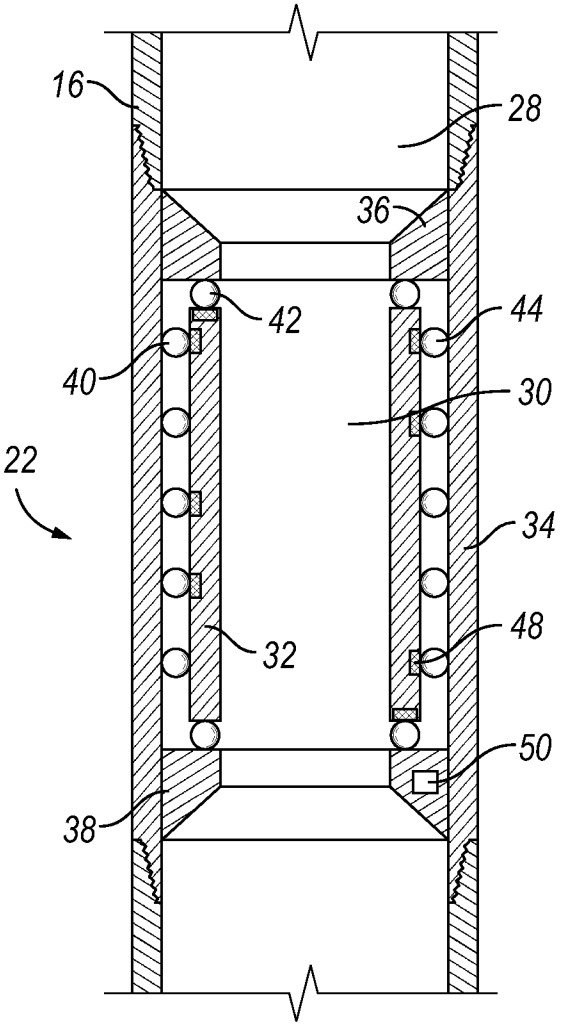
FIG. 2 is a section view of an actuator assembly, in accordance with an embodiment of this disclosure.

Looking at FIGS. 2 and 3, actuator assembly 22 is a tubular shaped actuator assembly with an actuator bore 30. Actuator assembly 22 can be secured to a downhole end of a joint of drill string 16. Actuator assembly 22 has an actuator bore 30 that extends axially the length of actuator assembly 22. The drilling fluid can flow through the drill string 16, including actuator assembly 22, out the drill bit, up annulus 18, and back up to terranean surface 14.

Actuator assembly 22 includes first pipe member 32 and second pipe member 34. First pipe member 32 and second pipe member are co-axially oriented. Second pipe member 34 can be secured to the downhole end of a joint of drill string 16 so that second pipe member 34 rotates with drill string 16. Second pipe member 34 can have a diameter that is substantially similar or the same as the diameter of an adjacent joint of drill string 16. First pipe member 32 can be supported by second pipe member 34. First pipe member 32 can, for example, be supported between uphole support 36 and downhole support 38. Uphole support 36 and downhole support 38 can extend radially from second pipe member 34.

In the embodiment of FIG. 2, actuator bore 30 is smaller than string bore 28 of adjacent joints of drill string 16 and defines the fluid flow path through actuator assembly 22. The diameter of first pipe member 32 is smaller than the diameter of second pipe member 34. Second pipe member 34 circumscribes first pipe member 32. Uphole support 36 and downhole support 38 extend radially inward from an inner diameter surface of second pipe member 34.

In the embodiment of FIG. 3 actuator bore 30 has a substantially similar diameter as string bore 28 of adjacent joints of drill string 16 and defines the fluid flow path through actuator assembly 22. The diameter of first pipe member 32 is larger than the diameter of second pipe member 34. First pipe member 32 circumscribes second pipe member 34. Uphole support 36 and downhole support 38 extend radially outward from an outer surface of second pipe member 34.

Looking at FIGS. 2-3, a plurality of bearings 40 can be positioned between first pipe member 32 and second pipe member 34. Bearings 40 can be ball bearings. An end bearing 42 can be located between an end surface of first pipe member 32 and a support member. As an example, end bearing 42 can be located between an uphole end of first pipe member 32 and uphole support 36. End bearing 42 can alternately be located between a downhole end of first pipe member 32 and downhole support 38. Bearings 40 can rotate with second pipe member 34 about a central axis of second pipe member 34. As an example, bearings 40 can be retained with second pipe member 34 by conventional bearing retention means.

Side bearing 44 is located between first pipe member 32 and second pipe member 34. In the example embodiment of FIG. 2, side bearing 44 can be located between an outer diameter surface of first pipe member 32 and an inner diameter surface of second pipe member 34. Side bearing 44 rotates with second pipe member 34 around an outer diameter surface of first pipe member 32. In the example embodiment of FIG. 3, side bearing 44 can be located between an outer diameter surface of second pipe member 34 and an inner diameter surface of first pipe member 32. Side bearing 44 can also be located radially exterior of first pipe member 32 within bearing housing 46. Side bearing 44 rotates with second pipe member 34 around an outer diameter surface of second pipe member 34.

Figure 5:
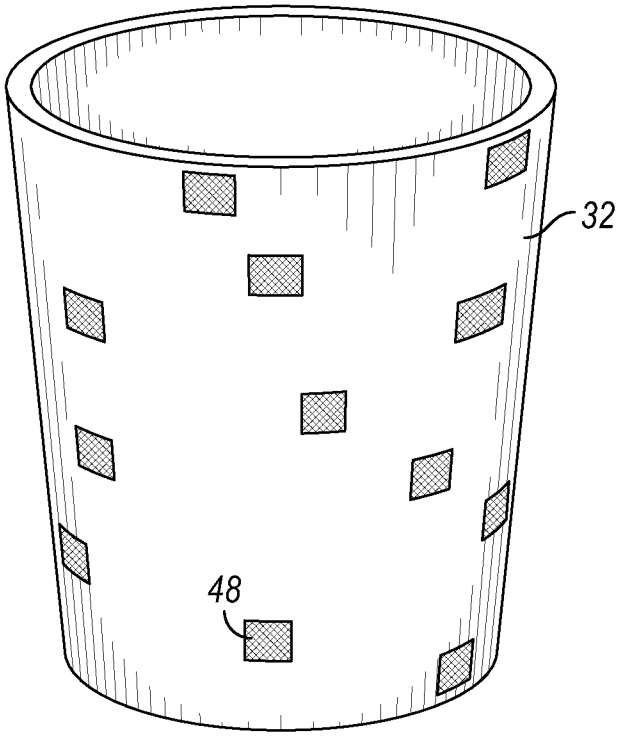
FIG. 5 is a perspective view of a first pipe member of an actuator assembly, in accordance with an embodiment of this disclosure.
Figure 4:
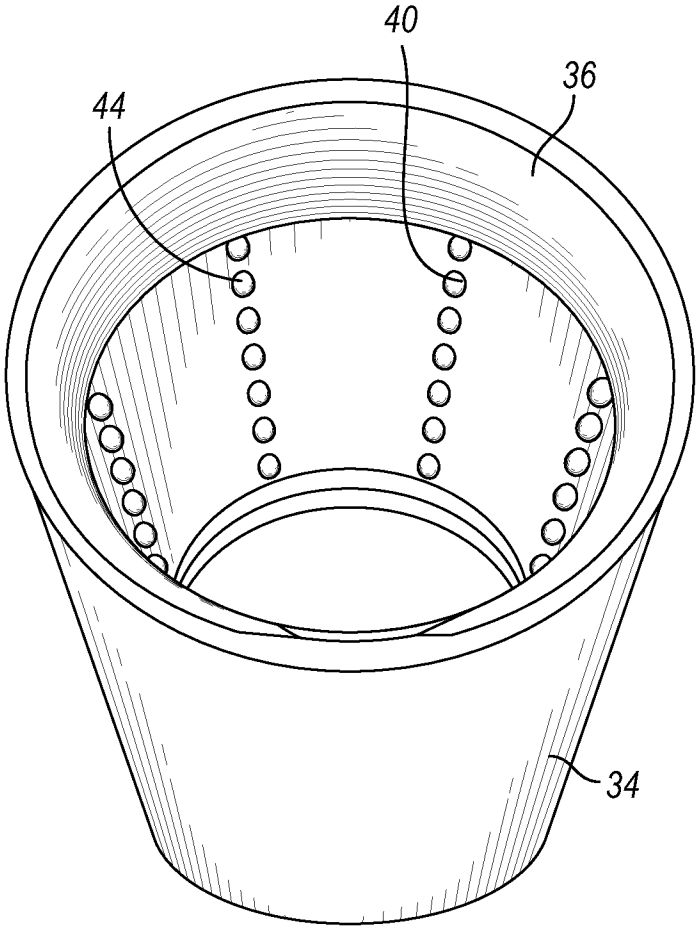
FIG. 4 is a perspective view of a second pipe member of an actuator assembly, in accordance with an embodiment of this disclosure.

Looking at FIG. 4, a series of side bearings 44 can be positioned in axially oriented rows spaced around an inner diameter surface of second pipe member 34. Looking at FIG. 5, an array of segments 48 are spaced around a surface of first pipe member 32. Segments 48 can be, for example, embedded in first pipe member 32 or be a coating applied to first pipe member 32. Segments 48 are positioned so that segments 48 are aligned with bearings 40. The segments are arranged in a specific configuration around first pipe member 32 which corresponds to signal patterns required to trigger or convey a specific command or instruction to a downhole tool, instrument, equipment, or other device. Looking at FIG. 2, as an example, segment 48 can be located on an outer diameter surface of first pipe member 32 and can be axially aligned with a side bearing 44. In alternate embodiments, segment 48 can be positioned at an uphole surface or downhole surface of first pipe member 32 and can be radially aligned with an end bearing 42.

Segment 48 can be formed of a first material and bearing 40 can be formed of a second material. The first material can be reactive to the second material. In an embodiment of the disclosure, as drill string 16 is rotated, second pipe member 34 will rotate relative to first pipe member 32. As an example, as drill string 16 is rotated, second pipe member 34 can rotate with drill string 16 and first pipe member 32 can remain static.

As bearing 40 rotates over and past segment 48, a reaction of the first material of segments 48 to the second material of bearing 40 can be sensed. The reaction of the first material of segments 48 to the second material of bearing 40 does not require a separate power source, such as a battery. As an example, the first material can have an opposite polarity as the second material. The voltage peaks are generated due to the exchange of charges between the first material of segments 48 to the second material of bearing 40. Certain materials are more inclined to gain electrons and other materials are more included to lose electrons. Electrons will be injected from the first material of segments 48 to the second material of bearing 40 if the first material of segments 48 has a higher polarity than the second material of bearing 40, resulting in oppositely charged surfaces. The first material of segments 48 to the second material of bearing 40 can be made of materials such as, polyamide, polytetrafluoroethylene (PTFE), polyethylene terephthalate (PET), polydimethylacrylamide (PDMA), polydimethylsiloxane (PDMS), polyimide, carbon nanotubes, copper, silver, aluminum, lead, elastomer, teflon, kapton, nylon or polyester.

Alternately, the first material of segments 48 can be a piezoelectric material and the second material can cause a mechanical stress on the first material. The first material of segments 48 can be, as an example, quartz, langasite, lithium niobate, titanium oxide, or any other material exhibiting piezoelectricity. In such an embodiment the piezoelectric segments are stressed when bearings 40 move over and along the surface of segments 48. The mechanical stresses experienced by the piezoelectric materials generate electric charges resulting in voltage peaks. The constant motion due to the rotation of drill string 16 while drilling wellbore 12 enables the piezoelectric segments to go through the motions of being stressed and released to generate voltage peaks.

Another alternate method of generating voltage peaks is by forming segments 48 from a magnetostrictive material such as terfenol-D, galfenol, metglas or any other material that showa magnetostricitve properties. The stress applied to the magnetostrictive segments 48 when bearings 40 move over and along segments 48 results in a change in the magnetic field of the magnetostrictive material. This induced magnetic field can be converted to a voltage by a planar pick-up coil or a solenoid that can be fabricated with segment 48.

Figure 6:
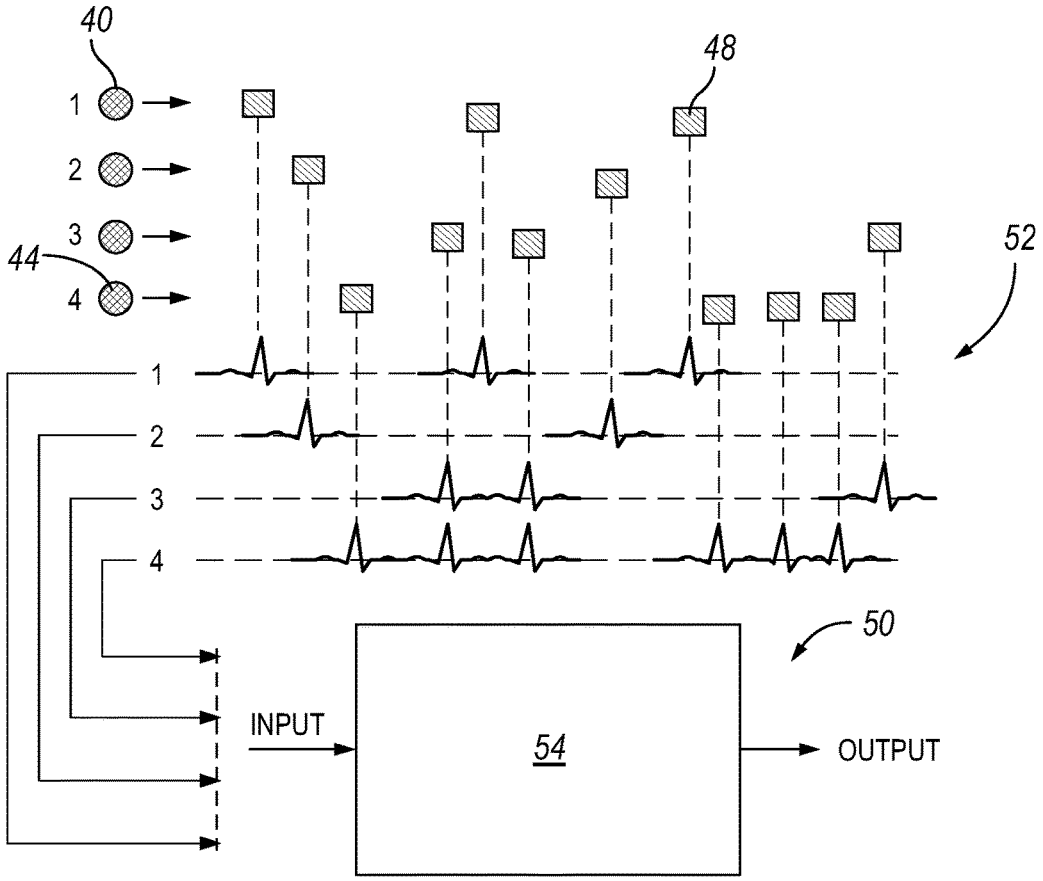
FIG. 6 is a schematic representation of a signal pattern generated by an actuator assembly, in accordance with an embodiment of this disclosure, shown with the drill pipe rotating in a single direction.

Looking at FIG. 6, each time a bearing 40 moves over and along a segment 48, a voltage peak is generated. The example amplitude and shape of the peak in FIG. 6 are for illustrative purposes and the amplitude and shape of the peak can be different depending on the size and shape of bearings 40 and segments 48 as well as the speed and frequency of rotation of second pipe member 34 relative to first pipe member 32.

The reaction of the first material of segments 48 to the second material of bearing 40 that is sensed as bearing 40 rotates over and past segment 48 and can be converted to a digital signal for interpretation by an electronics package 50 of actuator assembly 22 (FIG. 2). Electronics package 50 can include a digital logic circuit 54 for signal interpretation and can include an actuator system transceiver for signaling a downhole tool, instrument, equipment, and other device, based on the instructions received by way of the predetermined pattern of the rotation of drill string 16 (FIG. 1). The pattern can include, for example, a number of turns of drill string 16, a frequency, speed, or rate of rotation of drill string 16, or a direction of rotation of drill string 16.

Looking at FIG. 6 as drill string 16 rotates, continuous signal patterns 52 are generated with voltage peaks due to bearings 40 moving over and along segments 48, and with periods of no voltage when bearings 40 are rotating around the outer surface of first pipe member 32 where there are no segments 48. The voltage peaks are converted to digital signals by an analog-to-digital converter and connected as inputs to a digital logic circuit 54.

Digital logic circuit 54 can be a sequential logic circuit, where the output is not only a function of the inputs but is also a function of a sequence of past inputs. In order to store past inputs, sequential circuits have state or memory. Such features allow actuator assembly 22 to interpret the sequence of voltage peaks over time and provide a control signal to a downhole tool, instrument, equipment, and other device to perform a specific action.

Figure 7:
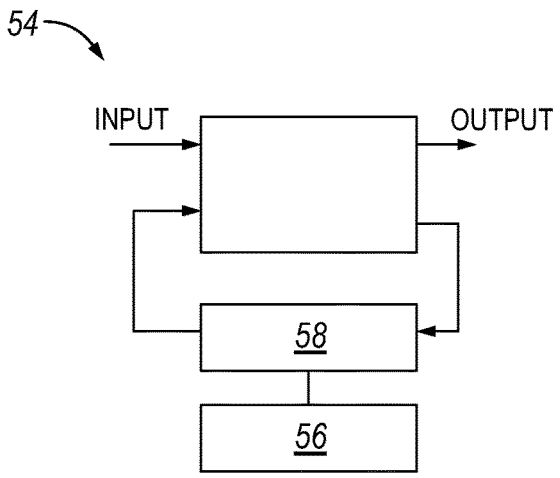
FIG. 7 is a schematic representation of a digital logic circuit of an actuator assembly, in accordance with an embodiment of this disclosure.

The sequential logic circuits can be synchronous, asynchronous or a combination of both. Looking at FIG. 7, synchronous sequential circuits have a clock 56. Memory 58 is connected to clock 56. Memory 58 receives inputs of all of the memory elements of the circuit, which generate a sequence of repetitive pulses to synchronize all internal changes of state. There are two types of sequential circuits, pulsed output and level output. In pulsed output circuits the output remains throughout the duration of an input pulse or the clock pulse for clocked sequential circuits. In level output sequential circuits the output changes state at the initiation of an input or clock pulse and remains in that state until the next input or clock pulse.

Figure 8:
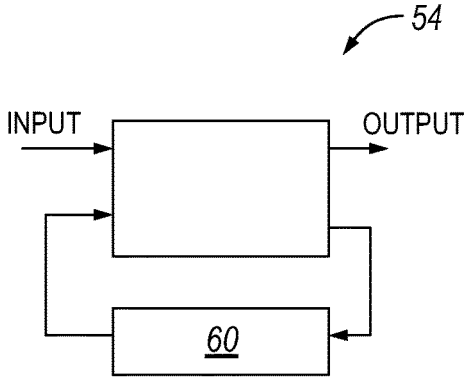
FIG. 8 is a schematic representation of a digital logic circuit of an actuator assembly, in accordance with an alternate embodiment of this disclosure.

Looking at FIG. 8, asynchronous sequential circuits do not have a periodic clock and the outputs change directly in response to changes in the inputs. Asynchronous sequential circuits are faster because they are not synchronized by a clock and the speed to process the inputs is only limited by the propagation delays of the logic gates in feedback loop 60 used in the circuit. However, asynchronous sequential circuits are harder to design due to timing problems arising from time-delay propagation not always being consistent throughout the stages of the circuit. The digital logic circuits can be implemented as an integrated circuit (IC) such as a field-programmable gate array (FPGA), application-specific integrated circuit (ASIC), complex programmable logic device (CPLD) or system on a chip (SoC).

Looking at FIG. 6, bearings 40 are side bearings 44 and second pipe member 34 is rotating in a single direction relative to first pipe member 32. During the drilling process the signals will have the same sequences with peak voltage amplitudes followed by periods of zero or very low voltage since drill string 16 will be rotating a single direction, at approximately the same speed. In embodiments of this disclosure drill string 16 can, as an example, be rotated in an anti-clockwise direction to drill wellbore 12 (FIG. 1).

Figure 9:
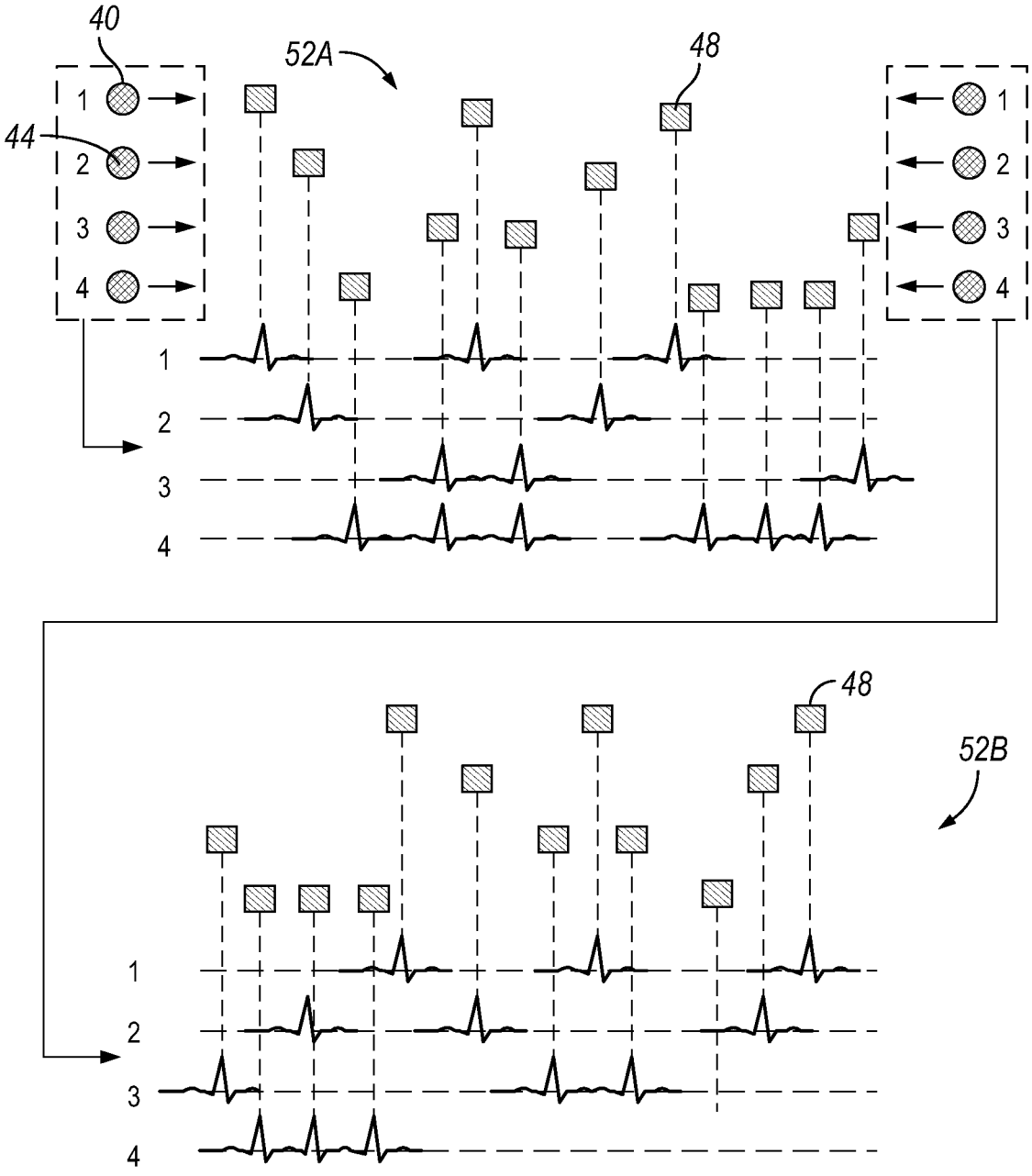
FIG. 9 is a schematic representation of continuous signal patterns generated by an actuator assembly, in accordance with an embodiment of this disclosure, shown with the drill pipe rotating in both an anticlockwise and clockwise direction.

Digital logic circuit 54 will compare the signal sequences over a given time period, clock cycle or fixed set of rotations and make a decision to enable, disable or perform no action in relation to a downhole tool, instrument, equipment, or other device. Actuator assembly 22 can be programmed to perform no action if the signal patterns are the same over the comparison period. However, if the direction of rotation is changed from anticlockwise to a clockwise direction as shown in FIG. 9 then the sequence of signals changes. This change in the sequence of voltage peaks can be utilized to develop unique code sequences to execute various downhole process.

Looking at FIG. 9, continuous signal patterns 52A are a result of drill string 16 being rotated in an anticlockwise direction so that second pipe member 34 rotates anticlockwise relative to first pipe member 32. When drill string 16 changes direction and rotates in a clockwise direction, second pipe member 34 rotates clockwise relative to first pipe member 32. The resulting continuous signal patterns 52B has a different pattern than continuous signal patterns 52A. Digital logic circuit 54 can recognize this change in pattern.

Actuator assembly 22 can be controlled from the surface. For example, during drilling operations bearings 40 move along and over segments 48 in an anticlockwise direction. If the sequence has to be changed to actuate a downhole tool, instrument, equipment, or other device, then drilling can be ceased, the drill bit can be lifted off the bottom of wellbore 12 and the drill string 16 can be rotated from the surface in a clockwise direction. Digital logic circuit 54 of actuator assembly 22 will recognize the difference in the signal sequence patterns and send a control signal to the downhole tool, instrument, equipment, or other device to perform an appropriate action.

When the drill bit is off the bottom of wellbore 12, drill string 16 can be rotated anticlockwise or clockwise to generate a large number of signal sequence patterns, which can be translated to perform different functions. Moreover, there can be multiple actuator assembly 22, each with unique segment patterns, placed at one or various locations in drill string 16. Therefore, a number of downhole tools, instruments, equipment, or other devices can be controlled and triggered from the surface.

An alternate method of generating a unique signal sequence patter is by changing the frequency of the rotation of drill string 16 in the anticlockwise direction, the clockwise direction, or in both directions, over one or multiple cycles. The rotation speed can be i) increased and then decreased or decreased and increased in one direction; ii) increased in the anticlockwise direction and decreased in the clockwise direction; iii) increased in the clockwise direction and decreased in the anticlockwise direction; or iv) any combination of increase/decrease in anticlockwise/clockwise directions.

In other alternate embodiments, the size and shape of segments 48 can be changed to generate signals of different amplitudes, widths and shapes. These signal patterns can then be used to identify the direction of rotation of the drill string assembly. In such a case digital logic circuit 54 can recognize the direction of rotation and initiate action to actuate a downhole tool, instrument, equipment, or other device after a specific number of rotations. Digital logic circuit 54 can also compare rotation directions over a specific number of rotations.

Figure 10:
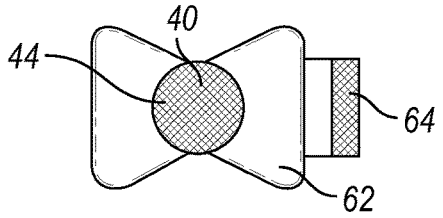
FIG. 10 is an elevation view of a bearing assembly of an actuator assembly, in accordance with an embodiment of this disclosure.
Figure 11:
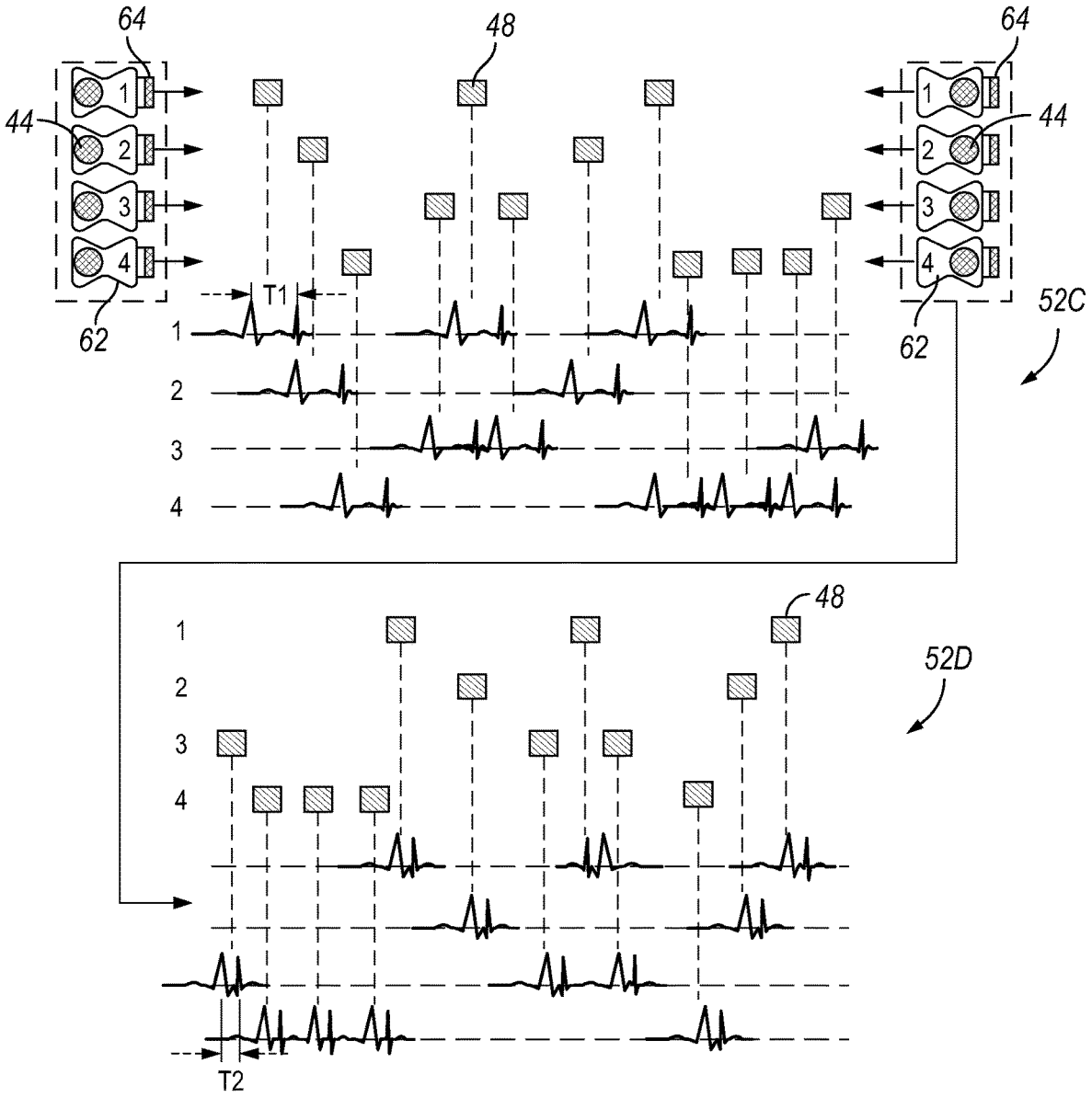
FIG. 11 is a schematic representation of continuous signal patterns generated by an actuator assembly, in accordance with an alternate embodiment of this disclosure, shown with the drill pipe rotating in both an anticlockwise and clockwise direction.

In yet other alternate embodiments, looking at FIGS. 10-11, another method to distinguish the direction of rotation of drill string 16 is to provide bearings 40 within latch slot 62. Latch slot 62 is a slot within second pipe member 34. Bearings 40, which are side bearings 44, will shift to the side of latch slot 62 relative to the direction of angular acceleration created by the rotation of drill string 16. On one side of latch slot 62 is cylindrical roller bearing 64.

The rotation of drill string 16 will cause side bearing 44 to move within latch slot 62 in a direction that is opposite to the direction of the rotation of drill string 16. As an example, when drill string 16 is rotating in an anticlockwise direction side bearing 44 is driven in a clockwise direction within latch slot 62 resulting in continuous signal patterns 52C. When drill string 16 is rotating in a clockwise direction side bearing 44 is driven in an anticlockwise direction within latch slot 62 resulting in continuous signal patterns 52D. The presence of the smaller cylindrical roller bearing 64 results in a peak of shorter width because cylindrical roller bearing 64 is in contact with segment 48 for a shorter duration of time compared to side bearings 44.

When drill string 16 is rotating in an anticlockwise direction side bearing 44 is further away from cylindrical roller bearing 64 compared to when drill string 16 is rotating in the clockwise direction. Therefore, when drill string 16 is rotating in an anticlockwise direction the time difference T1 between the peak due to side bearing 44 moving along a segment 48 and the peak due to cylindrical roller bearing 64 moving along the segment 48 is larger than the time difference T2. T2 is the time difference between the peak due to side bearing 44 moving along a segment 48 and the peak due to cylindrical roller bearing 64 moving along the segment 48 when drill string 16 is rotating in a clockwise direction. Therefore continuous signal patterns 52C are not only different from continuous signal patterns 52D due to drill string 16 rotating in a opposite direction, but because time difference T1 and time difference T2, which can be utilized to identify the direction of rotation of drill string 16.

Figure 12:
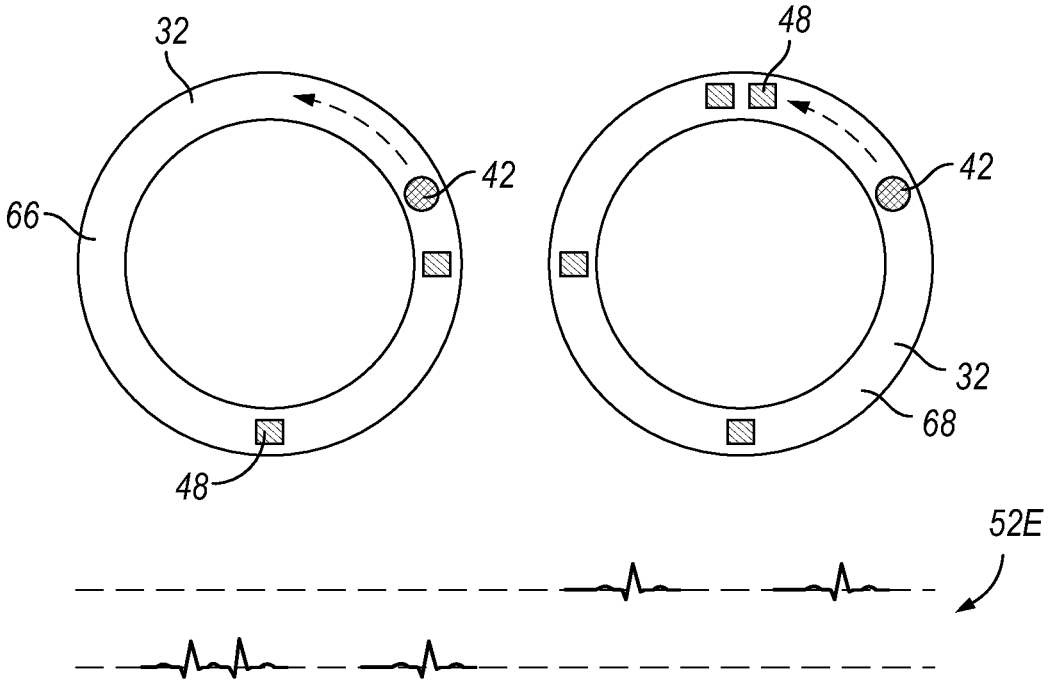
FIG. 12 is a is a schematic representation of continuous signal patterns generated by end bearings of an actuator assembly, in accordance with an alternate embodiment of this disclosure, shown with the drill pipe rotating in an anticlockwise direction.
Figure 13:
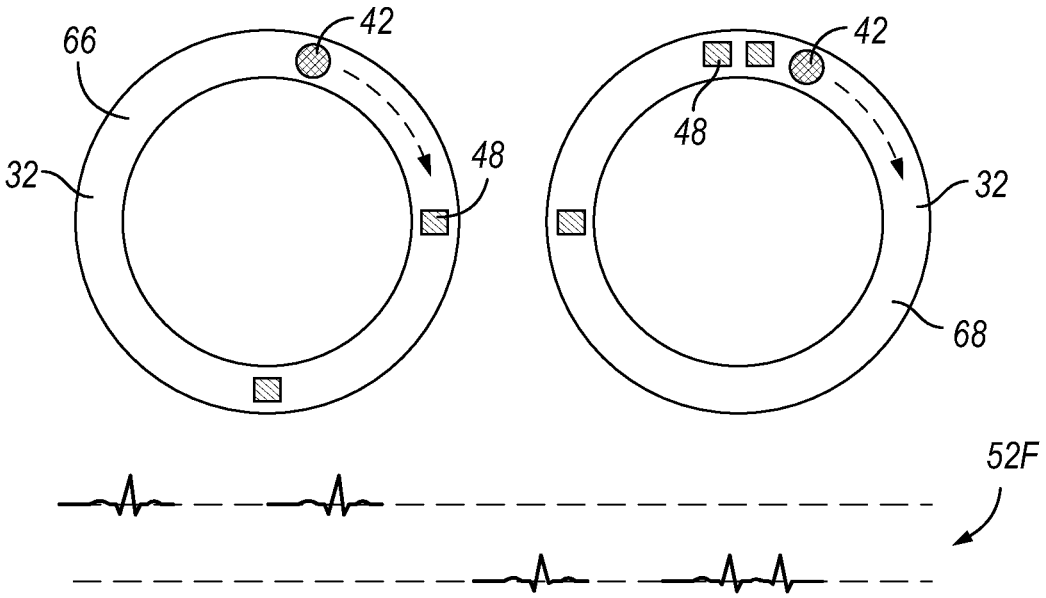
FIG. 13 is a is a schematic representation of continuous signal patterns generated by end bearings of an actuator assembly, in accordance with an alternate embodiment of this disclosure, shown with the drill pipe rotating in a clockwise direction.

In still other embodiments, a unique signal pattern can be generated by segments 48 that are located at the ends of first pipe member 32. Looking at FIGS. 12-13, uphole end 66 of first pipe member 32 can include a series of segments 48 and downhole end 68 of first pipe member can include different patter of a series of segments 48. As end bearings 42 move along and over segments 48, a signal pattern is generated. When drill string 16 is rotated anticlockwise, then second pipe member rotates in a direction anticlockwise relative to first pipe member 32 and continuous signal patterns 52E of FIG. 12 are generated. When drill string 16 is rotated anticlockwise, then second pipe member rotates in a direction anticlockwise relative to first pipe member 32 and continuous signal patterns 52F of FIG. 13 are generated.

Figure 14:
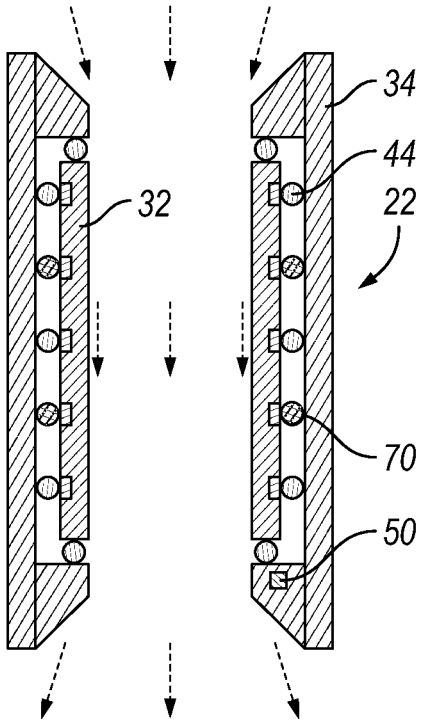
FIG. 14 is a section view of an actuator assembly, in accordance with an embodiment of this disclosure, shown with changeable bearings.
Figure 15:
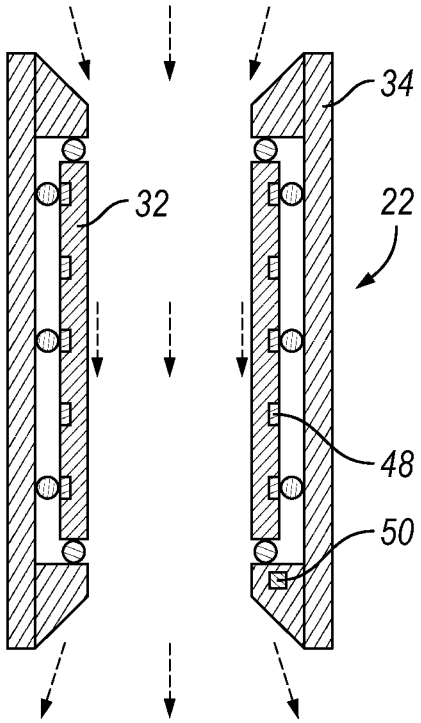
FIG. 15 is a section view of an actuator assembly, in accordance with an embodiment of this disclosure, shown after changeable bearings have been dissolved.

Looking at FIGS. 14-15, in other alternate embodiments, different unique signal patterns can be generated by the use of changeable bearings 70. At least one of the bearings 40 can be a changeable bearing. Changeable bearing 70 can include a dissolvable material. By dissolving the dissolvable material of changeable bearing 70, the signal pattern can be changed to allow for a different instruction to be delivered to device 24.

Figure 16:
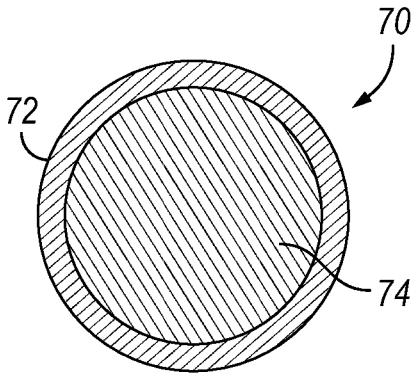
FIG. 16 is a section view of a changeable bearing of an actuator assembly, in accordance with an embodiment of this disclosure.

Looking at FIG. 16, changeable bearing 70 can have outermost layer 72 that can be formed of the dissolvable material. In certain embodiments, changeable bearing 70 includes core bearing 74 that is formed of an electrically insulating material. The electrically insulating material is non-reactive to the first material. The non-reactive material of core bearing 74 can be made of materials such as carbide, silicide, oxide, nitride, or the mixture of any of these materials. In such an embodiment, outermost layer 72 can be the second material that is reactive to the first material.

Figure 17:
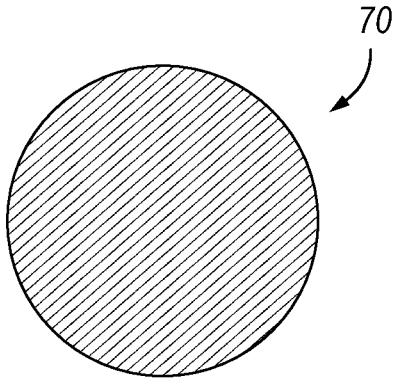
FIG. 17 is a section view of a changeable bearing of an actuator assembly, in accordance with an alternate embodiment of this disclosure.

Looking at FIG. 17, in other alternate embodiments, the entire changeable bearing 70 can be formed of the dissolvable material. In such an embodiment, the dissolvable material is the second material and is reactive to the first material.

In embodiments where the dissolvable material is the second material, the dissolvable material can be any of metallic based material that can be dissolved in the downhole environment. More specifically, the dissolvable metal can be either a magnesium based alloy, or an aluminum based alloy. The dissolving rates of these alloys depend greatly on downhole temperature and fluid composition. The dissolving rates depend on downhole pressure to a much lesser degree. The exact composition of the dissolvable material that is the second material can be selected based on the known downhole temperature, pressure and fluid composition of a particular well that will result in the desired dissolving rate.

Alternately, a preferred dissolvable material can be selected and the dissolving rate can be adjusted by pumping fluids into subterranean well 10 that can either speed up or slow down the dissolving rate of the dissolvable material. As an example, if an operator wishes to speed up the dissolving rate of a dissolvable material, the operator can pump a higher-concentration brine or acid into subterranean well so that such brine or acid comes into contact with the dissolvable material. If a brine is used, the resultant in the dissolving reaction can be metal hydroxide powder, which has low dissolvability in brine and can be flushed away by the dynamic flow of downhole fluid. If an acid is used, the resultant in the dissolving reaction can be ions fully dissolved in the solutions.

Figure 18:
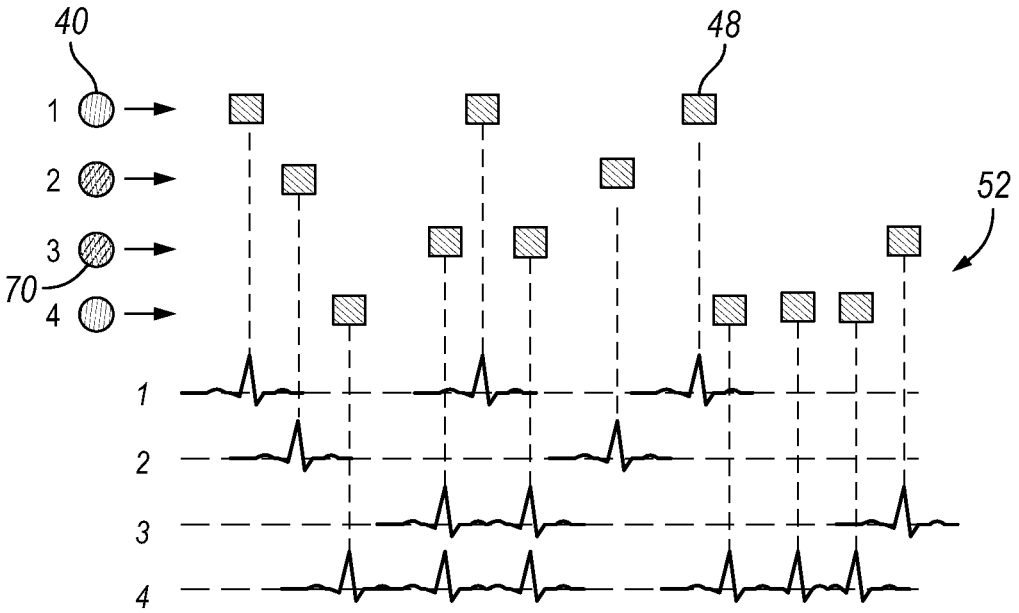
FIG. 18 is a schematic representation of a signal pattern generated by an actuator assembly, in accordance with an embodiment of this disclosure, shown with the drill pipe rotating in a single direction, and shown with changeable bearings.

Looking at FIG. 18, when outermost layer 72 of changeable bearing 70 is the second material or when changeable bearing 70 is formed entirely of the second material, when actuator assembly 22 is first delivered into subterranean well 10, each of the bearings 40 will react with segments 48 to generate continuous signal pattern 52. Signal pattern 52 is interpreted by digital logic circuit 54 to provide a control signal to a downhole tool, instrument, equipment, and other device to perform a specific action.

The dissolvable material that is the second material of changeable bearing 70 can then be dissolved. The dissolvable material can be formed of a material that has been selected to dissolve over a predetermined time based on the temperature and the fluid composition and to a lesser extent, the pressure downhole within subterranean well 10. Alternately the operator can pump a selected fluid into subterranean well that will affect the dissolving rate of the dissolvable material of changeable bearing 70.

Figure 19:
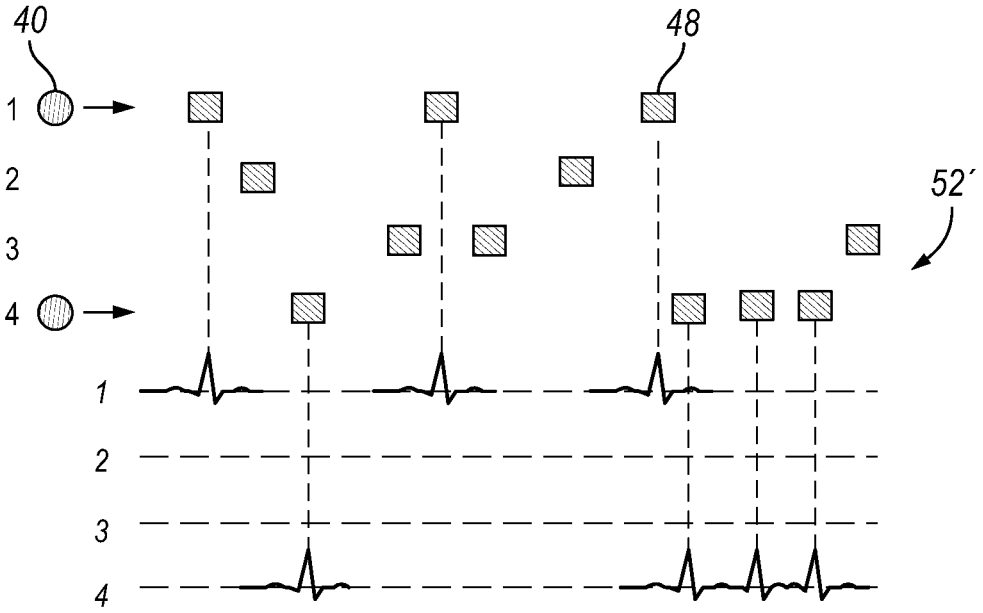
FIG. 19 is a schematic representation of a signal pattern generated by an actuator assembly, in accordance with an embodiment of this disclosure, shown with the drill pipe rotating in a single direction, and shown after changeable bearings have been dissolved.

Looking at FIG. 19, after the dissolvable material of changeable bearing 70 has dissolved, each of the remaining bearings 40 will react with segments 48 to generate continuous signal pattern 52'. Because of the lack of reaction of certain bearings that were reactive in the generation of signal pattern 52 of FIG. 18, signal pattern 52' is a revised signal pattern. Signal pattern 52' can be interpreted by digital logic circuit 54 to provide a control signal or instruction to a different downhole tool, instrument, equipment, or other device to perform a specific action. Alternately, signal pattern 52' can be interpreted by digital logic circuit 54 to provide a revised control signal or revised instruction to a downhole tool, instrument, equipment, or other device to perform a specific action.

In alternate embodiments, looking at FIG. 16, core bearing 74 can be formed of the second material, and outermost layer 72 can be a dissolvable material that is non-reactive to the first material. In such an embodiment, outermost layer 72 can be a dissolvable polymer. As an example, the dissolvable polymer can be a polyglycolic acid (PGA), polylactic acid (PLA), polymers poly(lactide-co-glycolide), polyanhydride, poly(propylene fumarate), polycaprolactone (PCL), polyethylene glycol (PEG), or a polyurethane. The dissolvable polymer can be degraded by hydrolysis in which the long chains of these polymers can be broken down to smaller polymers when exposed to water or humidity, so that they lose the structural integrity and the mechanical properties.

Outermost layer 72 that is formed of a dissolvable polymer can fall apart under a certain low load or erosion. Furthermore, with time and temperature increase, the dissolvable polymers with smaller chains can become acids, such as glycolic acid (for PGA) or lactic acid (for PLA). When the dissolvable polymer reaches such a stage, there is no solid part remaining. The dissolving or degradation rate of the dissolvable polymers is strongly dependent on the temperature and fluid composition of the wellbore fluids.

Figure 20:
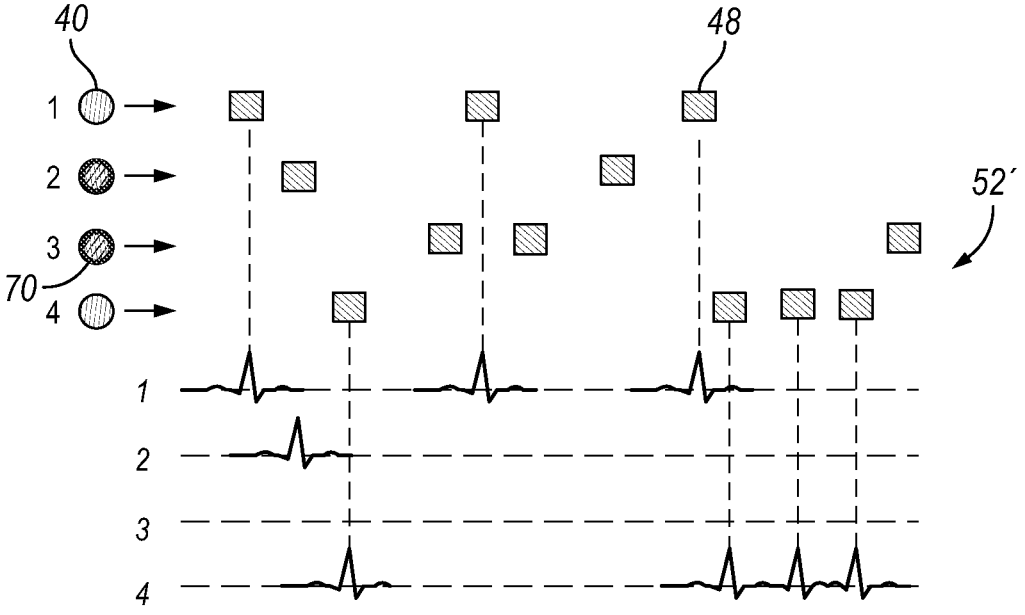
FIG. 20 is a schematic representation of a signal pattern generated by an actuator assembly, in accordance with an alternate embodiment of this disclosure, shown with the drill pipe rotating in a single direction, and shown with changeable bearings.

Looking at FIG. 20, when outermost layer 72 of changeable bearing 70 is a dissolvable polymer that is non-reactive with the first material, when actuator assembly 22 is first delivered into subterranean well 10, only certain of the bearings 40 will react with segments 48 to generate continuous signal pattern 52. Changeable bearings 70 that have the outermost layer 72 of dissolvable polymer will not react with segment 48. Signal pattern 52 is interpreted by digital logic circuit 54 to provide a control signal to a downhole tool, instrument, equipment, and other device to perform a specific action.

The dissolvable material of changeable bearing 70 that is a dissolvable polymer can then be dissolved or degraded. The dissolvable material can be formed of a material that has been selected to dissolve over a predetermined time based on the temperature and the fluid composition and to a lesser extent, the pressure downhole within subterranean well 10. Alternately the operator can pump a selected fluid into subterranean well that will affect the dissolving rate of the dissolvable material of changeable bearing 70.

Figure 21:
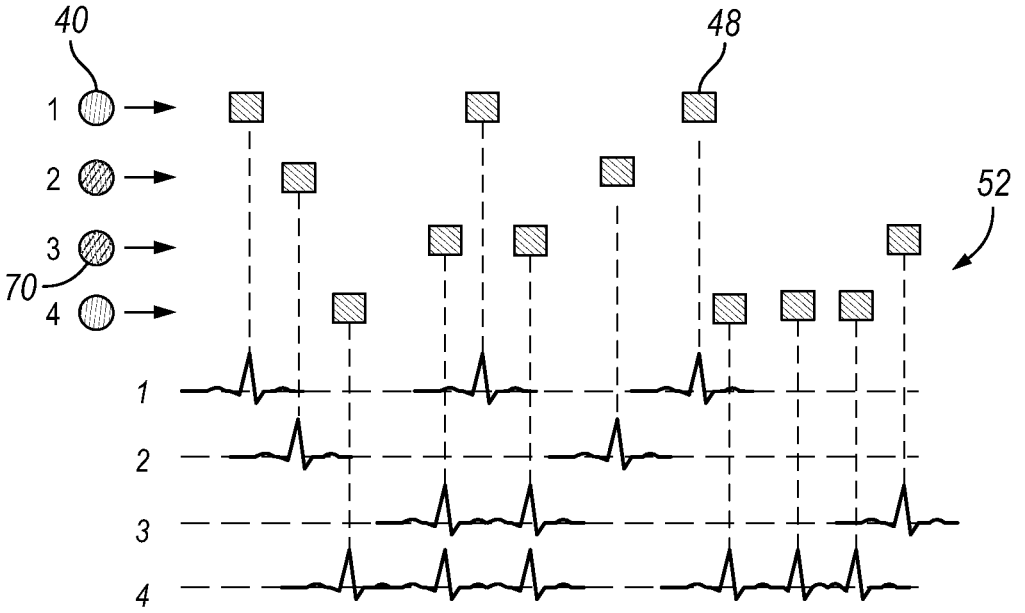
FIG. 21 is a schematic representation of a signal pattern generated by an actuator assembly, in accordance with an embodiment of this disclosure, shown with the drill pipe rotating in a single direction, and shown after changeable material of the changeable bearings have been dissolved.

Looking at FIG. 21, after the dissolvable material of changeable bearing 70 has dissolved, core bearing 74 of each changeable bearing 70 will be exposed. Each of the bearings 40, including changeable bearings 70 will now react with segments 48 to generate continuous signal pattern 52'. Because of the addition of the reaction of changeable bearings 70 which were previous non-reactive in the generation of signal pattern 52 of FIG. 20, signal pattern 52' is a revised signal pattern. Signal pattern 52' can be interpreted by digital logic circuit 54 to provide a control signal or instruction to a different downhole tool, instrument, equipment, or other device to perform a specific action. Alternately, signal pattern 52' can be interpreted by digital logic circuit 54 to provide a revised control signal or revised instruction to a downhole tool, instrument, equipment, or other device to perform a specific action.

Figure 22:
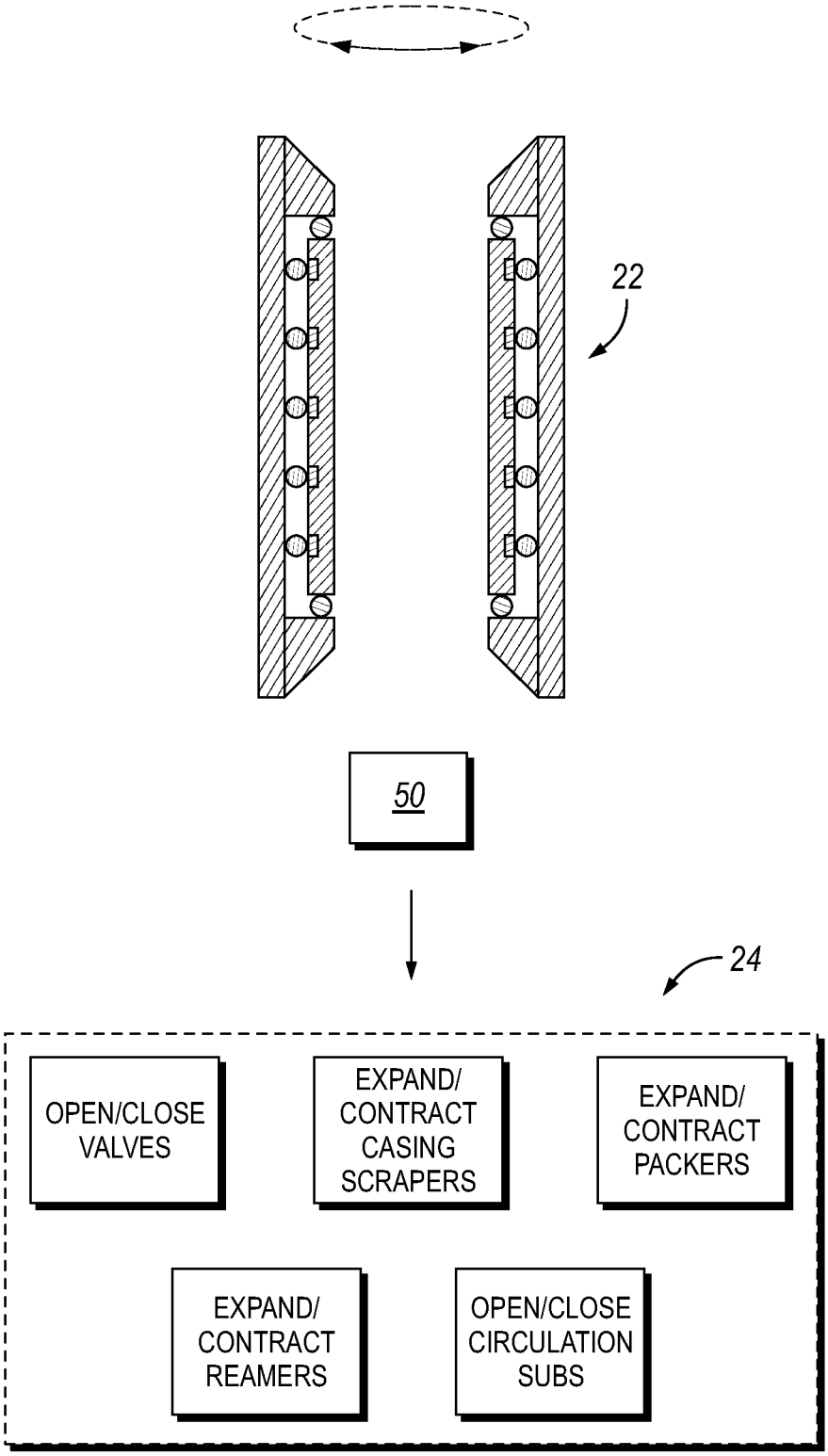
FIG. 22 is a schematic representation of example applications of the actuation assembly, in accordance with an embodiment of this disclosure.

Looking at FIG. 22, signal patterns generated by actuator assembly 22 can be used to instruct actuator assembly 22 to signal a variety of downhole tools, instruments, equipment, or other devices. As an example, actuator assembly 22 can be used for actuating downhole circulation subs to facilitate drilling and wellbore cleaning operations. Actuator assembly 22 can be used to send a trigger signal to open the circulation sub by sliding a sleeve or opening a valve to divert the drilling fluid directly into the annulus. This operation increases drilling fluid flow in the annulus and aids wellbore cleaning and can also split flow between the annulus and the drill string assembly. Once the operation is completed, actuator assembly 22 can be sent another trigger signal to close the circulation sub.

In alternate embodiments, actuator assembly 22 can be used for actuating bypass valves at a selected depth below fractures so that lost circulation material can be pumped through the bypass valves to plug the fractures. After the operation, instructions are conveyed from the surface through actuator assembly 22 to close the valves immediately of after a certain period of time. Similar operations can be performed to change the drilling fluid or to pump cement into the wellbore at desired depths. Actuator assembly 22 can further be utilized to activate and deactivate flapper valves and stimulation sleeves.

In other alternate embodiments, actuator assembly 22 can be used for actuating drilling reamers for increasing the size of the wellbore below casing. A drilling underreamer is a tool with cutters that is located behind a drill bit. Reamers are utilized to enlarge, smooth and condition a wellbore for running casing or completion equipment without any restrictions. Instead of pulling the drill string assembly out of the well when problems arise downhole, a reamer can be activated by actuator assembly 22. The underreamer then extends and drills through with the drill bit. Another trigger signal can be sent from the surface to actuator assembly 22 retract the underreamer. Actuator assembly 22 can be programmed to extend or retract reamers in several finite steps depending on the desired diameter of the wellbore.

In still other alternate embodiments, actuator assembly 22 can be used to expand and retract casing scrapers. Casing scrapers are utilized to remove debris and scale left by drilling fluids on the internal casing. Casing scrapers can be run with a drilling assembly in retracted mode while drilling an open hole section. The scrapers can be expanded at any time, for example when tripping out of hole, to scrape internal casing or critical zones in internal casing.

In yet other alternate embodiments, actuator assembly 22 can be used to expand and contract an inflatable, production, or test packer. Expanded packers seal the wellbore to isolate zones in the wellbore and also function as a well barrier. Production or test packers are set in cased holes while inflatable packers are set in both open and cased holes.

Actuator assembly 22 can alternately be used for sending command signals from the surface to set liner hangers.

During drilling operations, charges are constantly being produced due to bearings 40 moving over and along segments 48, especially while drilling. These charges not only generate signal patterns, but can also be converted from an analog signal to a digital signal by a bridge rectifier and stored in a di-electric capacitor de-rated for use at high temperatures, or can be stored in a ceramic, an electrolytic or a super capacitor. By storing the energy in a capacitor, actuator assembly 22 can also act as a power source.

Figure 23C:
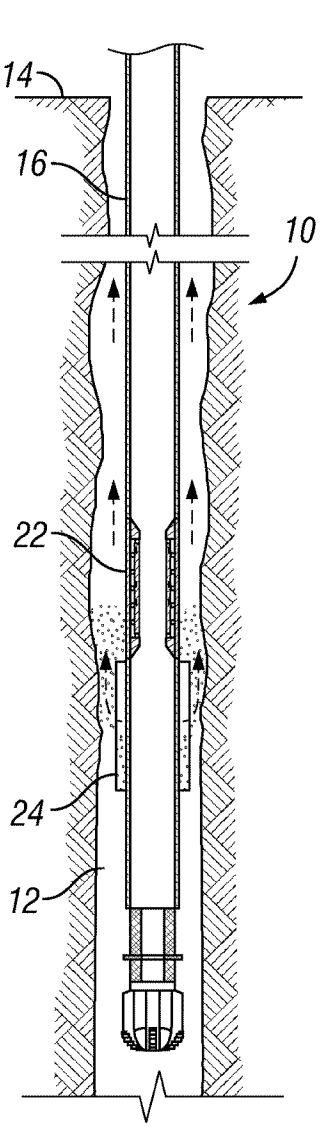
FIGS. 23A-23C are section views of an operation of the actuation assembly, in accordance with an embodiment of this disclosure.
Figure 23B:
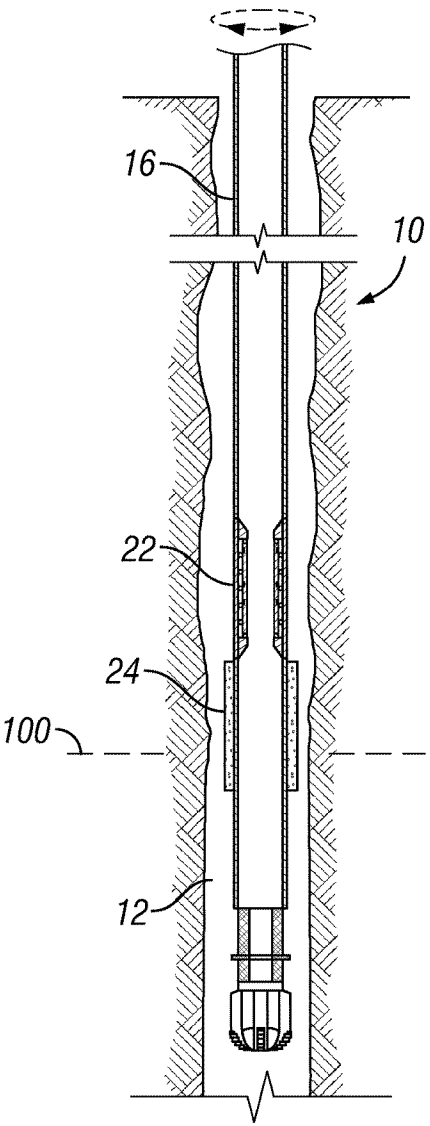
Figure 23A:
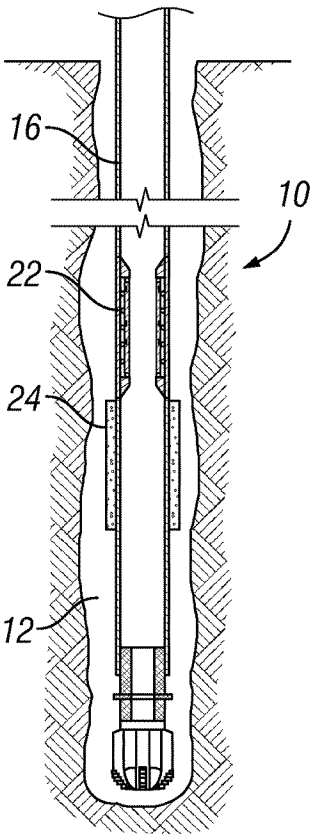

In an example of operation, looking at FIG. 23A device 24 that is instructed by actuator assembly 22 can be a compartment with a door that can be opened and closed by actuator assembly 22 to release a product from the compartment. Drill string 16 with actuator assembly 22 and with device 24 is extended into wellbore 12 of subterranean well 10. Drill string 16 is used to drill subterranean well 10, penetrating through a variety of downhole rock formations. Looking at FIG. 23B, in certain embodiments, drilling can be ceased after passing through a target depth 100 so that device 24 is located adjacent to the target depth.

Looking at FIG. 23C, once the target depth 100 is reached by device 24, the driller can pull the drill bit off the bottom of wellbore 12 and can rotate drill string 16 in different directions and frequencies to generate unique signal pattern from the surface that is a predetermined signal. The signal patterns are then translated into a specific action. As an example, the signal pattern can be an instruction to open a door of device 24 to allow for the release of product into subterranean well 10.

If additional operations are required to be performed within subterranean well 10 and new unique signal pattern is required, then dissolvable material of changeable bearing 70 can be dissolved so that previous signal pattern 52 becomes revised signal pattern 52', as disclosed in FIGS. 18-19 and FIGS. 20-21. The revised signal pattern 52' can be used to provide instructions for performing a different operation with the same device 24, or can be used to provide instructions to a new or different device 24.

Therefore embodiments of this disclosure provide systems and methods for actuating different devices, tools, and instruments from the surface it also enables the execution of discrete drilling workflows in real-time. Systems and methods of this disclosure can be controlled from the surface. The actuation system is a separate system that can be seamlessly integrated with downhole tools, devices, and instruments so that the actuation system does not displace existing drilling portfolios. The proposed actuation system and methods not only allows the redesign of workflows to increase drilling efficiency but can also facilitate drilling automation by closing one of the key technology gaps, communicating with and delivering trigger signals to downhole actuation systems in real-time. Because the signal patterns are unique to a specific operation, such as releasing a selected number or type of sensors, discrete drilling workflows can be executed without affecting other downhole tools instruments, devices, or operations.

Embodiments of this disclosure allow for the generation of additional signal patterns by changing the number of reactionary bearings. These additional signal patterns could be utilized to control more than one tools or devices.

Figure 24:
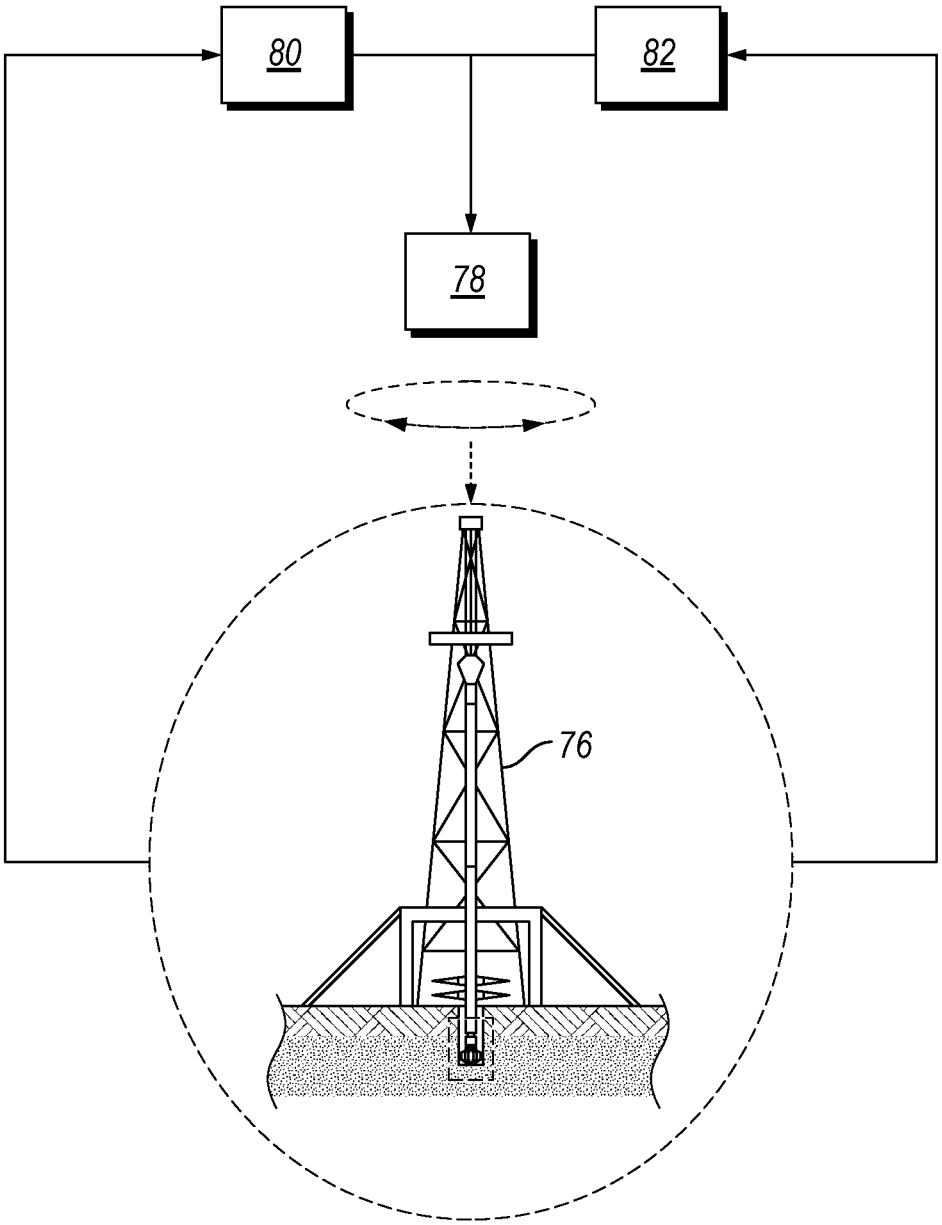
FIG. 24 is a schematic of a downhole actuation system that can be controlled from the surface to actuate digitally enabled downhole devices, according to one or more example embodiments.

Looking at FIG. 24 fourth industrial revolution (referred to as "4IR") technologies such as artificial intelligence, machine learning, big data analytics, and robotics are progressing at a very rapid rate. According to an embodiment of this disclosure, human intervention to control the downhole actuation device in a drilling rig 76 can be replaced by an intelligent drilling system 78. The intelligent drilling system 78 performs optimized drilling operations based on smart drilling dynamics 80 and smart hydraulic systems 82. For example, raw data from the various sensors on a rig can be extracted, analyzed and turned into useful information by the smart drilling dynamics 80 and smart hydraulic systems 82. If a wellbore needs to be cleaned based on the data received then this can be conveyed to the intelligent drilling system 78, which in turn can rotate the drill pipe in the required configurations to generate specific sequences utilizing the actuating system. The sequences can then be converted to a specific trigger signal to open bypass valves to divert the drilling fluid into the annulus to increase the annular velocity and clean the wellbore.

One embodiment is a downhole actuation system that can be controlled from the surface to actuate digitally enabled downhole devices or tools or instruments. Actuation of different devices or tools or instruments enables the execution of discrete drilling workflows. The actuation system is a separate system that can be seamlessly integrated with downhole tools or devices or instruments so it does not displace existing drilling portfolios.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A system for instructing a device within a wellbore of a subterranean well, the system including:

a drill string extending into the subterranean well from a terranean surface, the drill string having an actuator assembly; where the actuator assembly has:

a first pipe member with a segment formed of a first material;

a second pipe member coaxially aligned with the first pipe member;

a plurality of bearings positioned between the first pipe member and the second pipe member, each of the plurality of bearings including a second material, where the first material is reactive to the second material, and where at least one of the plurality of bearings is a changeable bearing that includes a dissolvable material; and where the actuator assembly is operable to instruct an operation of the device by generating an instruction signal by rotating the first pipe member relative to the second pipe member and interpreting a pattern of a reaction of the segment as the plurality of bearings rotate past the segment.

2. The system of claim 1, where the changeable bearing has an outermost layer of the dissolvable material, where the dissolvable material is the second material.

3. The system of claim 2, where the changeable bearing include a core bearing formed of an electrically insulating material, which is coated by the outermost layer of the dissolvable material.

4. The system of claim 2, where the entire changeable bearing is formed of the dissolvable material.

5. The system of claim 1, where the changeable bearing includes a core bearing formed of the second material that is coated by an outermost layer of a dissolvable polymer that is the dissolvable material and that is non-reactive to the first material.

6. The system of claim 1, where the plurality of bearings includes a side bearing, and where the segment is located on an outer diameter surface of the first pipe member and is axially aligned with the side bearing, the side bearing being located between the outer diameter surface of the first pipe member and an inner diameter surface of the second pipe member.

7. The system of claim 1, where the plurality of bearings includes a side bearing, and where the segment is located on an inner diameter surface of the first pipe member and is axially aligned with the side bearing, the side bearing being located between the inner diameter surface of the first pipe member and an outer diameter surface of the second pipe member.

8. The system of claim 1, further including a support member extending radially inward from an inner diameter surface of the second pipe member, the support member supporting the first pipe member within a central bore of the second pipe member.

9. The system of claim 8, where the plurality of bearings includes an end bearing, and where the segment is positioned at and end surface of the first pipe member and is radially aligned with the end bearing, the end bearing being located between the end surface of the first pipe member and the support member secured to the second pipe member that extends radially from the second pipe member.

10. The system of claim 1, where the actuator assembly further includes a digital logic circuit configured to receive and to interpret the pattern of the reaction of the segment as the plurality of bearings rotate past the segment, and to generate the instruction signal.

11. The system of claim 1, where the second pipe member is operable to rotate with the drill string and the first pipe member is located within the second pipe member and is circumscribed by the second pipe member.

12. The system of claim 1, where the second pipe member is operable to rotate with the drill string and the first pipe member circumscribes the second pipe member.

13. A method for instructing a device within a wellbore of a subterranean well, the method including:

extending a drill string into the subterranean well from a terranean surface, the drill string having an actuator assembly, where the actuator assembly has:

a first pipe member with a segment formed of a first material;

a second pipe member coaxially aligned with the first pipe member;

a plurality of bearings positioned between the first pipe member and the second pipe member, each of the plurality of bearings including a second material, where the first material is reactive to the second material, and where at least one of the plurality of bearings is a changeable bearing that includes a dissolvable material; and instructing an operation of the device with the actuator assembly by generating an instruction signal by rotating the second pipe member relative to the first pipe member and interpreting a pattern of a reaction of the segment as the plurality of bearings rotate past the segment.

14. The method of claim 13, further including dissolving the dissolvable material and instructing a subsequent operation of the device with the actuator assembly by generating a revised instruction signal by rotating the second pipe member relative to the first pipe member and interpreting a revised pattern of the reaction of the segment as the plurality of bearings rotate past the segment.

15. The method of claim 14, where the changeable bearing has an outermost layer of the dissolvable material and a core bearing formed of an electrically insulating material, where the dissolvable material is the second material, and where dissolving the dissolvable material includes dissolving the outermost layer of the dissolvable material so that the changeable bearing is non-reactive to the first material.

16. The method of claim 14, where the entire changeable bearing is formed of the dissolvable material, where the dissolvable material is the second material, and where dissolving the dissolvable material includes dissolving the entire changeable bearing.

17. The method of claim 14, where the changeable bearing includes a core bearing formed of the second material that is coated by an outermost layer of a dissolvable polymer that is the dissolvable material and that is non-reactive to the first material, and where dissolving the dissolvable material includes dissolving the outermost layer of the dissolvable material so that the changeable bearing is reactive to the first material.

18. The method of claim 13, where the plurality of bearings includes a side bearing, and where the segment is located on an outer diameter surface of the first pipe member and is axially aligned with the side bearing, the side bearing being located between the outer diameter surface of the first pipe member and an inner diameter surface of the second pipe member, and where interpreting the pattern of the reaction of the segment as the plurality of bearings rotate past the segment includes interpreting the reaction of the segment as the side bearing rotates past the segment.

19. The method of claim 13, where the plurality of bearings includes a side bearing, and where the segment is located on an inner diameter surface of the first pipe member and is axially aligned with the side bearing, the side bearing being located between the inner diameter surface of the first pipe member and an outer diameter surface of the second pipe member and where interpreting the pattern of the reaction of the segment as the plurality of bearings rotate past the segment includes interpreting the reaction of the segment as the side bearing rotates past the segment.

20. The method of claim 13, further including supporting the first pipe member within a central bore of the second pipe member with a support member extending radially inward from an inner diameter surface of the second pipe member.

21. The method of claim 20 where the plurality of bearings includes an end bearing, and where the segment is positioned at and end surface of the first pipe member and is radially aligned with the end bearing, the end bearing being located between the end surface of the first pipe member and the support member secured to the second pipe member that extends radially from the second pipe member and where interpreting the pattern of the reaction of the segment as the plurality of bearings rotate past the segment includes interpreting the reaction of the segment as the end bearing rotates past the segment.

22. The method of claim 13, where the actuator assembly further includes a digital logic circuit, the method further including receiving and interpreting the pattern of the reaction of the segment as the plurality of bearings rotate past the segment, and generating the instruction signal with the digital logic circuit.

23. The method of claim 13, where the second pipe member rotates with the drill string and the first pipe member is located within the second pipe member and is circumscribed by the second pipe member, where rotating the second pipe member relative to the first pipe member includes rotating the drill string.

24. The method of claim 13, where the second pipe member rotates with the drill string and the first pipe member circumscribes the second pipe member, where rotating the second pipe member relative to the first pipe member includes rotating the drill string.

* * * * *